US006761434B2

(12) United States Patent
Ishinaga et al.

(10) Patent No.: US 6,761,434 B2
(45) Date of Patent: Jul. 13, 2004

(54) LIQUID DISCHARGE HEAD, ELEMENT SUBSTRATE, LIQUID DISCHARGING APPARATUS AND LIQUID DISCHARGING METHOD

(75) Inventors: Hiroyuki Ishinaga, Tokyo (JP); Yoshinori Misumi, Tokyo (JP); Yoichi Taneya, Kanagawa (JP); Hiroyuki Sugiyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/910,930

(22) Filed: Jul. 24, 2001

(65) Prior Publication Data

US 2002/0030722 A1 Mar. 14, 2002

(30) Foreign Application Priority Data

Jul. 27, 2000 (JP) ..... 2000/227981

(51) Int. Cl.[7] ..... B41J 2/05
(52) U.S. Cl. ..... 347/65; 347/57
(58) Field of Search ..... 347/20, 56, 61, 347/63, 65, 67, 57–59

(56) References Cited

U.S. PATENT DOCUMENTS

| | | | | |
|---|---|---|---|---|
| 4,266,232 A | | 5/1981 | Juliana, Jr. et al. | 347/10 |
| 4,723,129 A | | 2/1988 | Endo et al. | 347/56 |
| 5,278,585 A | * | 1/1994 | Karz et al. | 347/65 |
| 5,293,182 A | | 3/1994 | Sekiya et al. | 347/62 |
| 5,877,786 A | | 3/1999 | Sekiya et al. | 347/15 |
| 5,975,667 A | | 11/1999 | Moriguchi et al. | 347/10 |

FOREIGN PATENT DOCUMENTS

| | | | |
|---|---|---|---|
| EP | 0 698 492 A | 2/1996 | |
| EP | 0 827 838 A | 3/1998 | |
| EP | 0 930 164 A | 7/1999 | |
| EP | 1 005 991 A | 6/2000 | |
| EP | 1 072 419 A2 | 1/2001 | B41J/2/14 |

OTHER PUBLICATIONS

Notification of the First Office Action, Patent Office of the People's Republic of China, Application No. 01137161.7.

* cited by examiner

*Primary Examiner*—Stephen D. Meier
*Assistant Examiner*—An Do
(74) *Attorney, Agent, or Firm*—Fitzpatrick, Cella Harper & Scinto

(57) ABSTRACT

A liquid discharge head includes plural heat generating members, each linearly communicating with a discharge port, a liquid flow path communicating with each discharge port and having a bubble generating area in which a movable member is provided, a limiting portion opposed to the bubble generating area in the liquid flow path for limiting displacement of the movable member, and a circuit for receiving data of a predetermined number of bits for each heat generating member and generating drive pulses for each heat generating member based on the respective input data. Substantial contact between the displaced movable member and the limiting portion renders a portion of the liquid flow path including the bubble generating area a substantially closed space except for the discharge port. The number of drive pulses generated from the input data is larger than the predetermined number of bits for at least one set of the data.

38 Claims, 22 Drawing Sheets

FIG. 13

| NUMBER OF PULSE | | D | C | B | A |
|---|---|---|---|---|---|
| 15 | | 0 | 0 | 0 | 0 |
| 14 | | 0 | 0 | 0 | 1 |
| 13 | | 0 | 0 | 1 | 0 |
| 12 | | 0 | 0 | 1 | 1 |
| 11 | | 0 | 1 | 0 | 0 |
| 10 | | 0 | 1 | 0 | 1 |
| 9 | | 0 | 1 | 1 | 0 |
| 8 | | 0 | 1 | 1 | 1 |
| 7 | | 1 | 0 | 0 | 0 |
| 6 | | 1 | 0 | 0 | 1 |
| 5 | | 1 | 0 | 1 | 0 |
| 4 | | 1 | 0 | 1 | 1 |
| 3 | | 1 | 1 | 0 | 0 |
| 2 | | 1 | 1 | 0 | 1 |
| 1 | | 1 | 1 | 1 | 0 |
| 0 | | 1 | 1 | 1 | 1 |

SET

RCO
OUTPUT 6 PULSES
1111−0110=1001

FIG. 18

| PULSE INTERVAL | | D | C | B | A |
|---|---|---|---|---|---|
| 15 | | 0 | 0 | 0 | 0 |
| 14 | | 0 | 0 | 0 | 1 |
| 13 | | 0 | 0 | 1 | 0 |
| 12 | | 0 | 0 | 1 | 1 |
| 11 | | 0 | 1 | 0 | 0 |
| 10 | | 0 | 1 | 0 | 1 |
| 9 | | 0 | 1 | 1 | 0 |
| 8 | | 0 | 1 | 1 | 1 |
| 7 | | 1 | 0 | 0 | 0 |
| 6 | | 1 | 0 | 0 | 1 |
| 5 | | 1 | 0 | 1 | 0 |
| 4 | | 1 | 0 | 1 | 1 |
| 3 | | 1 | 1 | 0 | 0 |
| 2 | | 1 | 1 | 0 | 1 |
| 1 | | 1 | 1 | 1 | 0 |
| 0 | | 1 | 1 | 1 | 1 |

SET

RCO
OUTPUT 6 UNITS
1111−0110=1001

LIQUID DISCHARGE HEAD, ELEMENT SUBSTRATE, LIQUID DISCHARGING APPARATUS AND LIQUID DISCHARGING METHOD

BACKGROUND OF THE INVENTION

1. Field of the Invention

The present invention relates to a liquid discharging head, a liquid dicharging apparatus and a liquid discharging method for discharging desired liquid by applying thermal energy to the liquid, and more particularly to a liquid discharging head, an element substrate, a liquid charging apparatus and a liquid discharging method capable of discharging two or more liquid droplets in succession from a discharge port.

The present invention is applicable to various apparatus such as a printer for recording on media such as paper, yarn, fiber, textile, leather, metal, plastics, glass, wood, ceramics etc. a copying machine, a facsimile having a communication system, or a word processor having a printer unit, or to industrial recording apparatus coupled in complex manner to various processing apparatus.

In the present invention, "recording" means not only providing a recording medium with a meaningful image such as a character or an image but also providing with a meaningless image such as a pattern.

2. Related Background Art

There is already known a liquid jet recording method, so-called bubble jet recording method, in which energy such as heat is given to ink (liquid) to generate a rapid state change therein and the liquid is discharged from a discharge port by an action force resulting from such state change for deposition on a recording medium thereby forming an image. The recording apparatus utilizing such bubble jet recording method is generally provided, as disclosed in the U.S. Pat. No. 4,723,129, a discharge port for discharging the liquid, a liquid flow path communicating with the discharge port, and an electrothermal converting member constituting energy generating means for discharging the liquid present in the liquid flow path.

Such recording method has various advantages such as ability of recording high quality image with a high speed and with a low noise level, and ability for recording the image of a high resolution or even a color image with a compact apparatus, since discharge ports for discharging liquid can be arranged with a high density in the head for executing such recording method. For this reason, the bubble jet recording method is recently employed in various office equipment such as a printer, a copying machine, a facsimile etc. and is being adopted also in industrial system such as a text printing apparatus.

FIG. 23 is a schematic cross-sectional view around the electrothermal converting member of a conventional liquid discharge head for executing the recording by such recording method. In the illustrated example, the electrothermal converting member is composed of a resistance layer 100 and electrodes 101*a*, 101*b* laminated thereon and mutually spaced as a pair. Thus a heat generating portion 105, for generating heat by voltage application, is formed between the electrodes 101*a* and 101*b*, and such portion constitutes a bubble generating area where a bubble is generated by film boiling. On the resistance layer 100 and the electrodes 101*a*, 101*b*, there are formed two protective layers 102, 103 for protecting these components.

A discharge oppening for discharging liquid by the generation of a bubble 104 by the heat from the heat generating portion 105 may be provided, as in a case of opening S, in a position opposed to the heat generating portion 105 (so-called side shooter), or in a lateral position as in a case of opening E (so-called edge shooter). In either case, the bubble 104 in such configuration of the liquid discharge head grows larger toward a liquid chamber X with a relatively smaller liquid flow resistance, so that a bubble vanishing position 106 is in the central part of the heat generating portion 105 or is somewhat displaced toward the liquid chamber.

Thus, in the liquid discharge head as shown in FIG. 23, the liquid is relatively strongly pushed back toward the liquid chamber X together with the growth of the bubble 104. Consequently a meniscus, formed at the discharge port and constituting an interface between the liquid and the external atmosphere, shows a relatively large retraction and a relatively large vibration by the bubble extinction after the liquid discharge. Also in the bubble vanishing process, there are generated a liquid flow from the liquid chamber toward the heat generating portion 105 and a liquid flow from the discharge port toward the heat generating portion 105 in an approximately same magnitude whereby the practical start timing of liquid refilling toward the discharge port becomes after the liquid flow from the discharge port is almost finished and is relatively late, so that a relatively long time is required until the meniscus returns to the normal state and becomes stabilized. For this reason, for discharging liquid in succession, there is required a relative long interval between the discharges and the drive frequency capable of satisfactorily discharging the liquid is inevitably limited.

For increasing the drive frequency in the liquid discharge head, the present applicant already proposes a configuration provided with a movable member provided in the bubble generating area and adapted to displace along with the growth of the bubble and a limiting portion for limiting the displacement of the movable member within a desired range, wherein the limiting portion is provided opposed to the bubble generating area in the liquid flow path and, by the substantial contact between the displaced movable member and the limiting portion, the liquid flow path including the bubble generating area becomes a substantially closed space except for the discharge port. In such liquid discharge head, at the growth of the bubble, the movable member so displaces as to substantially close the liquid flow path at the upstream side of the bubble generating area, so that the liquid pushed back toward the upstream side at the bubble growth is relatively limited. At the bubble vanishing, the movable member so displaces as to reduce the liquid flow resistance at the upstream side, so that the bubble vanishing at the upstream side of the bubble generating area is accelerated and proceeds faster than in the downstream side. Therefore, the meniscus shows a smaller retraction and the liquid refilling is executed efficiently.

Also in the liquid discharge head, gas dissolved in the liquid may be released at the bubble generation to form a microbubble which may remain in the liquid flow path. In order to prevent defective discharging operation resulting from a large amount of such remaining microbubbles, there is periodically executed a recovery operation of sucking out the liquid in the vicinity of the discharge port thereby removing the microbubbles. On the other hand, in the liquid discharge head provided with the movable member, since the liquid is pushed back little to the upstream side, the microbubbles are emitted from the discharge port before they increase to a level hindering the liquid discharging operation and remains little in the liquid flow path. For this reason the recording operation can be executed continuously for a relatively long period, in excess of 100 sheets at maximum.

As explained in the foregoing, the liquid discharge head with the movable member, capable of rapid liquid refilling without a large retraction of the meniscus, has advantages of executing the liquid discharge with a relatively short interval and enabling drive with a relatively high frequency.

In order to enable drive with a higher frequency, it is conventionally conceived that a faster extinction of the bubble, generated for the preceding liquid discharge, is practically effective. This is because, in order to achieve the succeeding discharge in satisfactory manner, it is conceived that the succeeding discharge has to be executed after the meniscus returns to the stationary state and is stabilized after the vibration process and after the liquid refilling is completed, and because such completion of refilling and stabilization of the meniscus are achieved by the completion of the bubble vanishing.

However the bubble vanishing theoretically requires a certain time for completion, and such time results in a limit in the driving interval. More specifically, by applying a voltage pulse of a duration of several microseconds for the liquid discharge, the period required for generation, growth and vanishing of the bubble of the bubble can be made 30 to 50 $\mu$sec from the start of pulse application, in consideration of the delay in response. Consequently, the drive frequency is limited to 20 to 30 kHz if the next discharge is executed by applying a pulse immediately after the bubble vanishing. Therefore the present inventors have executed intensive investigation, considering that the technology cannot be advanced unless such reality is broken through, and have reached a novel liquid discharge method capable of liquid discharge in succession at a high frequency.

In the following there will be explained the novel liquid discharge method of the present inventors.

The novel liquid discharge method employs a liquid discharge head provided with a heat generating member for generating thermal energy for generating a bubble in the liquid, a discharge port for discharging liquid, a liquid flow path communicating with the discharge port and having a bubble generating area for generating a bubble in the liquid, a liquid chamber for supplying the liquid flow path with the liquid, a movable member provided in the bubble generating area and adapted to displace along with the bubble growth, and a limiting portion for limiting the displacement of the movable member in a desired range, wherein the liquid discharged from the discharge port by the energy at the bubble generation. In such liquid discharge head, the heat generating member and the discharge port are in linear communication, while the limiting portion is opposed to the bubble generating portion of the liquid flow path, and, by the substantial contact between the displaced movable member and the limiting portion, the liquid flow path having the bubble generating portion becomes a substantially closed space except for the discharge port. In this liquid discharge method, in causing the same discharge port to discharge a plurality of liquid droplets in succession, driving energy for a succeeding liquid discharge is supplied to the heat generating member in a state where a bubble, formed for the preceding liquid discharge and being still in the course of vanishing, is present at the discharge port side of the bubble generating area and no bubble is present at the side of the movable member.

Thus, this novel liquid discharge method is not to execute the drive for the succeeding liquid discharge after the extinction of the bubble formed at the preceding liquid discharge, but a remarkable invention of executing successive discharge, utilizing the bubble formed for the preceding liquid discharge, at a timing in consideration of the balance between the bubble formation for the succeeding liquid discharge and the liquid discharge.

More specifically, the novel liquid discharge method of the present inventors, being based on the aforementioned movable member providing the efficient refilling characteristics and on a fact that the bubble vanishing position is at the discharge port side of the bubble generating area in the liquid discharge head having such movable member, is attained by a finding that there is a timing capable of achieving satisfactory liquid discharge in the course of vanishing of the bubble for the preceding liquid discharge utilizing the relationship between the bubble change and the meniscus position. In the liquid discharge head having the movable member, there exists a timing at which a bubble formed for the preceding liquid discharge and being in the course of vanishing process is present at the discharge port side of the bubble generating area but no bubble is present at the side of the liquid chamber. At such timing, the retraction of the meniscus has started but has not reached the maximum. Also since the bubble already vanishes at the movable member side of the heat generating member, the liquid refilling is substantially completed. At such timing, therefore, the liquid discharge head is in a state extremely advantageous for the next liquid discharge, and liquid discharge in succession can be satisfactorily achieved by supplying the heat generating member with the driving energy for the next liquid discharge at such timing. The successive liquid discharge at such timing corresponds to liquid discharge in succession with a much shorter interval, in comparison with the conventional case where the next liquid discharge is executed after the bubble vanishing is completed.

In this liquid discharge method, the drive energy for the next liquid discharge is supplied to the heat generating member while the bubble formed for the preceding liquid discharge remains partly, so that, in the second and subsequent liquid discharges, there is obtained a pre-heating effect by the thermal energy generated in the preceding liquid discharge, thereby reducing the time required by the bubble to grow to the maximum size. Thus, there can be obtained an advantage that the bubble formation for the succeeding liquid discharge can be achieved immediately. Also such pre-heating effect can improve the efficiency of energy for the succeeding liquid discharge. Also such pre-heating effect can increase the volume of the liquid droplet discharged at the second or subsequent discharge, in comparison with that of the liquid droplet discharged at the stationary state.

Furthermore, the liquid flow toward the discharge port, resulting at the refilling and generated by the bubble vanishing in the upstream side of the bubble generating area, can accelerate the liquid flow in the succeeding liquid discharge, whereby the velocity of the discharged liquid droplet at the second or subsequent liquid discharge can be made larger than that in the liquid discharge executed from the stationary state.

Such increase in the volume or velocity of the consecutive liquid droplets in comparison with the ordinary state provides an advantage suitable for multi-level recording. For example it is possible to vary the recording density by employing two successive discharges and varying the interval between such two discharges or by varying the number of successive discharges with a constant interval between the discharges.

As explained in the foregoing, the present liquid discharge method enables liquid discharges in succession with a very short interval. It is also possible to capture a satellite, formed by separation of a trailing portion of a liquid droplet in the preceding liquid discharge, by a liquid droplet in the succeeding liquid discharge. Such capture of the satellite by the succeeding liquid droplet is advantageous for executing the multi-level recording.

The capture of the satellite by the succeeding liquid droplet is achieved for the first time by the successive liquid discharges with a very short interval by the novel liquid discharge method proposed by the present inventors. This liquid dischrage method comprises a step of heating liquid in the liquid flow path with a heat generating member thereby generating a bubble in the liquid, and a step of causing a discharge port communicating with the liquid flow path to discharge liquid thereby forming a liquid droplet by the energy at the bubble generation, wherein these steps are repeated plural times to discharge a plurality of liquid droplets in successive manner, and is featured by a fact that a satellite is captured by a liquid droplet discharged by the succeeding liquid discharge and is integrated with such liquid droplet.

The satellite becomes substantially spherical by surface intension in the course of flying, but, in the present liquid discharge method, the capture by the liquid droplet can be made while the satellite is still in a liquid rod shape immediately after formation of the satellite, and such fact also features the present liquid discharge method.

In case of applying the above-described novel liquid discharge method by the present inventors to a liquid discharge apparatus such as an ink jet recording apparatus, it is necessary to investigate the mode of supply of the drive signal to the liquid discharge head (ink jet recording head in case of an ink jet recording apparatus). In the following there will be considered a case where the liquid discharge apparatus is an ink jet recording apparatus having a liquid discharge head constituting an ink jet recording head.

In general, the ink jet recording apparatus executes recording by reciprocating the ink jet recording head, having a plurality of discharge ports for discharging liquid (ink), in a main scanning direction, while a recording medium such as paper or fabric is conveyed in a sub scanning direction. Therefore, the drive signal to the ink jet recording head is supplied from a main body of the apparatus to the ink jet recording head through a flexible cable. As the above-described liquid discharge recording is capable of high definition recording, the ink jet recording head is usually provided with several hundred discharge ports and heat generating members of a corresponding number. The heat generating members are collectively prepared in a required number by a thin film process (semiconductor manufacturing process) on an element substrate (also called heater board) composed of a semiconductor substrate such as of silicon.

It is not practical to provide a signal line for each heat generating member, for supplying a driving pulse thereto, and to connect the ink jet recording head and the main body of the apparatus by such signal line, because the number of such signal lines is too large and a circuit to be provided in the main body of the apparatus for driving the heat generating members becomes bulky. Therefore, also in the conventional ink jet recording apparatus, there is employed a method of multiplexing the drive signals for the heat generating members for transmission from the main body of the apparatus to the ink jet recording heat and demultiplexing such signals in the recording head, for selectively driving the heat generating members. Also there is employed a configuration of selectively driving the heat generating members by incorporating such heat generating members in a diode matrix.

Such demultiplexing circuit or the diodes constituting the diode matrix may be provided independently in the ink jet recording head, but, since the element substrate itself on which the heat generating members are formed is composed of a silicon semiconductor substrate, these members are usually formed on such element substrate.

As a result of investigation, however, the conventional configuration in which the demultiplexing circuit or the diode matrix is incorporated in the ink jet recording head is unable to fully exploit the features of the liquid discharge method newly proposed by the present inventors.

In this novel liquid discharge method, the discharge can be repeated from a discharge port (nozzle) with a frequency of several hundred kHz. Consequently the repeating period of the drive pulse applied to the heat generating member becomes about 10 $\mu$s at shortest, and, since the duration of the drive pulse is not much different from that in the conventional ink jet recording head, the duty ratio of the pulse becomes larger than in the conventional configuration and it becomes difficult for a simple diode matrix to drive the ink jet recording head having many discharge ports. Also in a configuration of transmitting the drive signals to the ink jet recording head after multiplexing, with the simple multiplexing of the signals for individually driving several hundred heat generating elements for example with a drive frequency of 100 kHz, the frequency of the signal after multiplexing becomes as high as several ten MHz, eventually resulting in a phenomenon that the data transfer cannot be executed in time. Also the flexible cable connecting the ink jet recording head and the main body of the apparatus has large impedance and parasite capacitance, so that the heat enable signal for driving the heat generating member may become distorted.

Furthermore, the novel liquid discharge method enables the multi-level recording by regulating the interval of the two successive discharge pulses or by varying the number of the liquid droplets discharged in succession as explained in the foregoing, but the conventional multiplexing method or the method utilizing the diode matrix is unable to handle such multi-level recording.

In order to achieve multi-level recording, it is necessary to provide each heat generating member with drive pulses of a matching number, and the multi-level recording, if tried with an extension of the conventional technology, requires an excessively high frequency in the signal from the main body of the apparatus to the recording head or an excessively large magnitude of the circuit to be incorporated in the recording head (element substrate), leading to a limitation in the chip area.

The multi-level recording can also be achieved in a discharge method other than the above-described liquid discharge method, namely in case of utilizing an energy generating element for discharging liquid from a discharge port, by discharging a plurality of liquid droplets. However, even in such case, there will be encountered drawbacks such as an excessively high frequency in the signal from the main body of the apparatus to the recording head or an excessively large magnitude of the circuit to be incorporated in the recording head (element substrate), leading to a limitation in the chip area.

Stated differently, there are strongly desired a liquid discharge head capable of multi-level recording with a limited number of the signal lines and with the signal of a relatively low frequency and also capable of reducing the magnitude of the circuit to be incorporated in the element substrate, and an element substrate to be used in such liquid discharge head.

SUMMARY OF THE INVENTION

In consideration of the foregoing, the object of the present invention is to provide a liquid discharge head suitable for various liquid discharge methods such as the novel liquid discharge method proposed by the present inventors and also for multi-level recording and capable of discharging liquid from the discharge ports by receiving a drive signal of a relatively low frequency, an element substrate adapted for use in such liquid discharge head, a liquid discharge apparatus utilizing such liquid discharge head, and a liquid discharge method utilizing such liquid discharge head.

A first liquid discharge head of the present invention comprises a plurality of heat generating members for generating thermal energy for generating a bubble in liquid, a discharge port provided for each heat generating member and constituting a portion for discharging the liquid, a liquid flow path communicating with the discharge port and having a bubble generating area for generating the bubble in the liquid, a movable member provided in the bubble generating area and adapted to displace along with the growth of the bubble, a limiting portion for limiting the displacement of the movable member within a desired range, and a circuit receiving data of a predetermined number of bits for each heat generating member and generating a drive pulse for the corresponding heat generating member based in the received data, wherein the heat generating member and the discharge port are in a linear communication state, the limiting portion is so provided as to be opposed to the bubble generating area in the liquid flow path, the liquid flow path including the bubble generating area reaches a substantially closed space except for the discharge port by the substantial contact between the displaced movable member and the limiting portion, the number of the drive pulses generated from the received data is larger than the aforementioned predetermined number of pulses at least for one of the aforementioned data, and the liquid discharged from the discharge port by the energy of bubble generation by the application of the drive pulse.

A second liquid discharge head of the present invention comprises:

a plurality of discharge ports constituting portions for discharging liquid;

an energy generating element provided for each discharge port, for generating energy for discharging the liquid; and a circuit for receiving an input of data of a predetermined number of bits, at least equal to 2 bits, for each energy generating element, and converting the entered data to generate a drive pulse for the corresponding energy generating element;

wherein the liquid is discharged from the discharge port by the energy generated by the application of the drive pulse to the energy generating element.

A third liquid discharge head of the present invention comprises a plurality of discharge ports constituting portions for discharging liquid, an energy generating element provided for each discharge port, for generating energy for discharging the liquid, and a circuit including a shift register for receiving serial data of a predetermined number of bits for each energy generating element and extracting, from the serial data, data for each energy generating element in the form of parallel data, a data decoder for decoding the parallel data and a logic circuit for generating a drive pulse for each energy generating element from a reference pulse based on the output of the data decoder, wherein the liquid is discharged from the discharge port by the energy generated by the application of the drive pulse to the energy generating element.

A first element substrate of the present invention integrally comprises a plurality of energy generating elements for generating energy for generating a bubble in liquid, a shift register for receiving serial data of a predetermined number of bits for each energy generating element and extracting, from the serial data, data for each energy generating element in the form of parallel data, means for decoding the parallel data for each heat generating member, and means for receiving a heat pulse and generating a drive pulse from the heat pulse according to the result of decoding, thereby applying the drive pulse to the corresponding energy generating element.

A second element substrate of the present invention integrally comprises a plurality of energy generating elements for generating energy for generating a bubble in liquid, a shift register for receiving serial data of a predetermined number of bits for each energy generating element and extracting, from the serial data, data for each energy generating element in the form of parallel data, and means provided for each heat generating member and adapted for generating drive pulses of a number represented by the corresponding parallel data for application to the corresponding energy generating element.

A third element substrate of the present invention integrally comprises a plurality of energy generating elements for generating energy for generating a bubble in liquid, a shift register for receiving serial data of a predetermined number of bits for each energy generating element and extracting, from the serial data, data for each energy generating element in the form of parallel data, and means provided for each heat generating member and adapted for generating two drive pulses with an interval represented by the corresponding parallel data for application to the corresponding energy generating element.

A liquid discharge apparatus of the present invention comprises a carriage for supporting the above-described liquid discharge head of the present invention, wherein the serial data are transmitted to the liquid discharge head to discharge liquid droplets therefrom while the carriage is moved according to the recording information.

A liquid discharge method of the present invention comprises discharging a plurality of liquid droplets in succession from a same discharge port with a liquid discharge head including a heat generating member for generating thermal energy for generating a bubble in liquid, a discharge port constituting a portion for discharging the liquid, a liquid flow path communicating with the discharge port and having a bubble generating area for generating the bubble in the liquid, a movable member provided in the bubble generating area and adapted to displace along with the growth of the bubble, a limiting portion for limiting the displacement of the movable member within a desired range, and a circuit receiving data of a predetermined number of bits for each heat generating member and generating a drive pulse for each heat generating member based on the received data, wherein the heat generating member and the discharge port are in a linear communication state, the liquid is discharged from the discharge port by the energy at the bubble generation, the limiting portion is so positioned as to be opposed to the bubble generating area of the liquid flow path, and the liquid flow path including the bubble generating area reaches a substantially closed space except for the discharge port by the substantial contact between the displaced movable member and the limiting portion, wherein the drive energy for the next liquid discharge is supplied to the heat generating member in a state where a bubble formed for the preceding liquid discharge and in the course of vanishing is present at the discharge port side of the bubble generating area and no bubble is present at the movable member side.

BRIEF DESCRIPTION OF THE DRAWINGS

FIG. 13 is a chart showing the relationship between the number of liquid droplets to be discharged in succession and a set value;

FIG. 18 is a chart showing the relationship between the interval of two drive pulses and a set value;

DETAILED DESCRIPTION OF THE PREFERRED EMBODIMENTS

Figure 1:
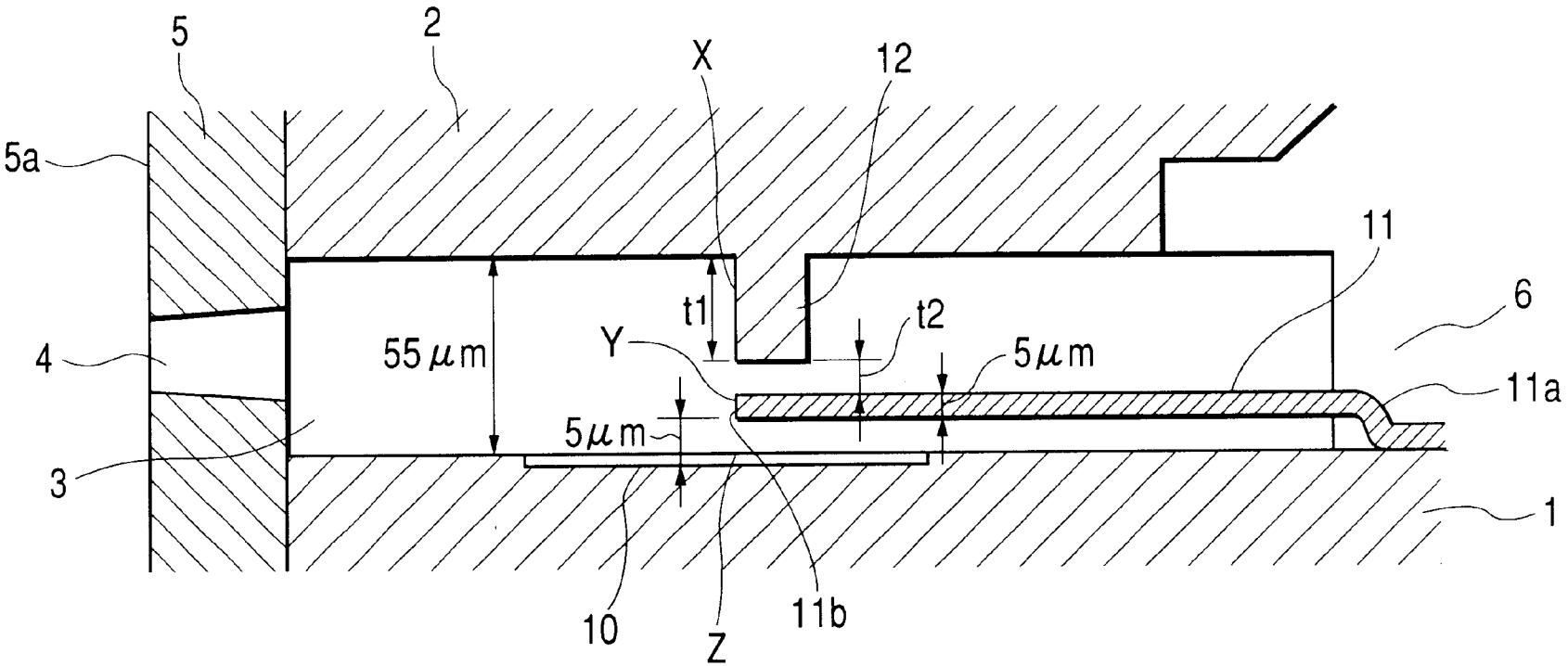
FIG. 1 is a schematic lateral cross-sectional view of a liquid discharge portion of a liquid discharge head in an embodiment of the present invention.

Now the present invention will be clarified in detail by preferred embodiments thereof, with reference to accompanying drawings. FIG. 1 is a schematic lateral cross-sectional view of a liquid discharging portion of a liquid discharge head constituting an embodiment of the present invention. The liquid discharge head shown in FIG. 1 is adapted for use in the novel liquid discharge method proposed by the present inventors. FIGS. 2A to 2E are views showing a single liquid droplet discharging process from the head shown in FIG. 1.

At first reference is made to FIG. 1 for explaining the configuration of the liquid discharge head.

The liquid discharge head is provided with an element substrate 1 including a heat generating member constituting bubble generating means and a movable member 11, a top plate 2 in which a stopper (limiting portion) 12 is formed, and an orifice plate 5 having a discharge port 4.

A flow path (liquid flow path) 3 in which liquid flows is formed by fixing of the element substrate 1 and the top plate 2 in a laminated state. The flow path 3 is formed in plurality in parallel state within a liquid discharge head, and communicates with the discharge port 4, for discharging liquid, formed at the downstream side (left side in FIG. 1). In the vicinity of the interface between the heat generating member 10 and the liquid, there is formed a bubble generating area. Also a common liquid chamber 6 of a large volume is provided at the upstream side (right side in FIG. 1) of the flow paths 3 so as to simultaneously communicate therewith. Thus the flow paths 3 are branched from the single common liquid chamber 6. The common liquid chamber 6 is formed higher than the flow path 3.

The movable member 11 is formed as a cantilever supported at an end and is fixed to the element substrate 1 at the upstream side of the ink (liquid) flow, whereby the downstream side portion of a fulcrum 11*a* is movable vertically with respect to the element substrate 1. In the initial state, the movable member 11 is approximately parallel to the element substrate 1 with a gap thereto.

The movable member provided on the element substrate 1 is so provided that a free end 11*b* is positioned at the approximate center of the heat generating member 10. A stopper 12 formed on the top plate 2 is adapted to come into contact with the free end 11*b* of the movable member 11, thereby limiting the upward displacement of the free end 11*b*. When the displacement of the movable member 11 is limited (when the movable member is in contact) by the contact of the movable member 11 with the stopper 12, the flow path 3 is substantially separated, by the movable member 11 and the stopper 12, into an upstream side thereof and a downstream side thereof.

The position X of the free end 11*b* and the position Y of the stopper 12 are preferably on a plane perpendicular to the element substrate 1. More preferably, such positions X, Y and the center Z of the heat generating member 10 are on a plane perpendicular to the element substrate 1.

Also the flow path 3 is so shaped that it becomes suddenly higher at the downstream side of the stopper 12. Such configuration does not hinder the bubble growth at the downstream side of the bubble generating area because the flow path has a sufficient height even when the movable member 11 is in contact with the stopper 12, thereby enabling smooth flow of the liquid toward the discharge port 4, and reduces the uneven distribution of the pressure in the vertical direction from the lower end to the higher end of the discharge port 4, thereby achieving satisfactory liquid discharge. Such flow path structure is not desirable in the conventional liquid discharge head without the movable member 11 because the liquid becomes stagnant in a portion where the flow path becomes higher at the downstream side of the stopper 12 and the bubble tends to remain in such stagnant portion, but, in the present embodiment, the influence of such remaining bubble is extremely reduced because the liquid flow also covers such stagnant portion as explained in the foregoing.

Also, after the stopper 12, the ceiling of the flow path rises suddenly at the side of the common liquid chamber 6. If the movable member 11 is absent in this configuration, it is difficult to direct the discharging pressure toward the discharge port 4 because the fluid resistance at the downstream side of the bubble generating area becomes smaller than that at the upstream side, but, in the present embodiment, since the bubble movement toward the upstream side of the bubble generating area is substantially intercepted by the movable member 11 at the bubble formation, whereby the discharging pressure is positively directed toward the discharge port 4, and the liquid supply to the bubble generating area is achieved promptly by the reduced fluid resistance at the upstream side of the bubble generating area.

In the above-described configuration, the bubble growth is not even in the downstream and upstream sides but is smaller in the upstream side, thereby suppressing the liquid movement to the upstream side. Such suppressed liquid flow in the upstream side reduces the meniscus retraction after the discharge, and correspondingly reduces the protrusion of the meniscus beyond the orifice plane (liquid discharge plane 5) at the refilling. Consequently the vibration of the meniscus is suppressed, thereby realizing stable discharge in all the drive frequencies from low to high frequency range.

Figure 4:
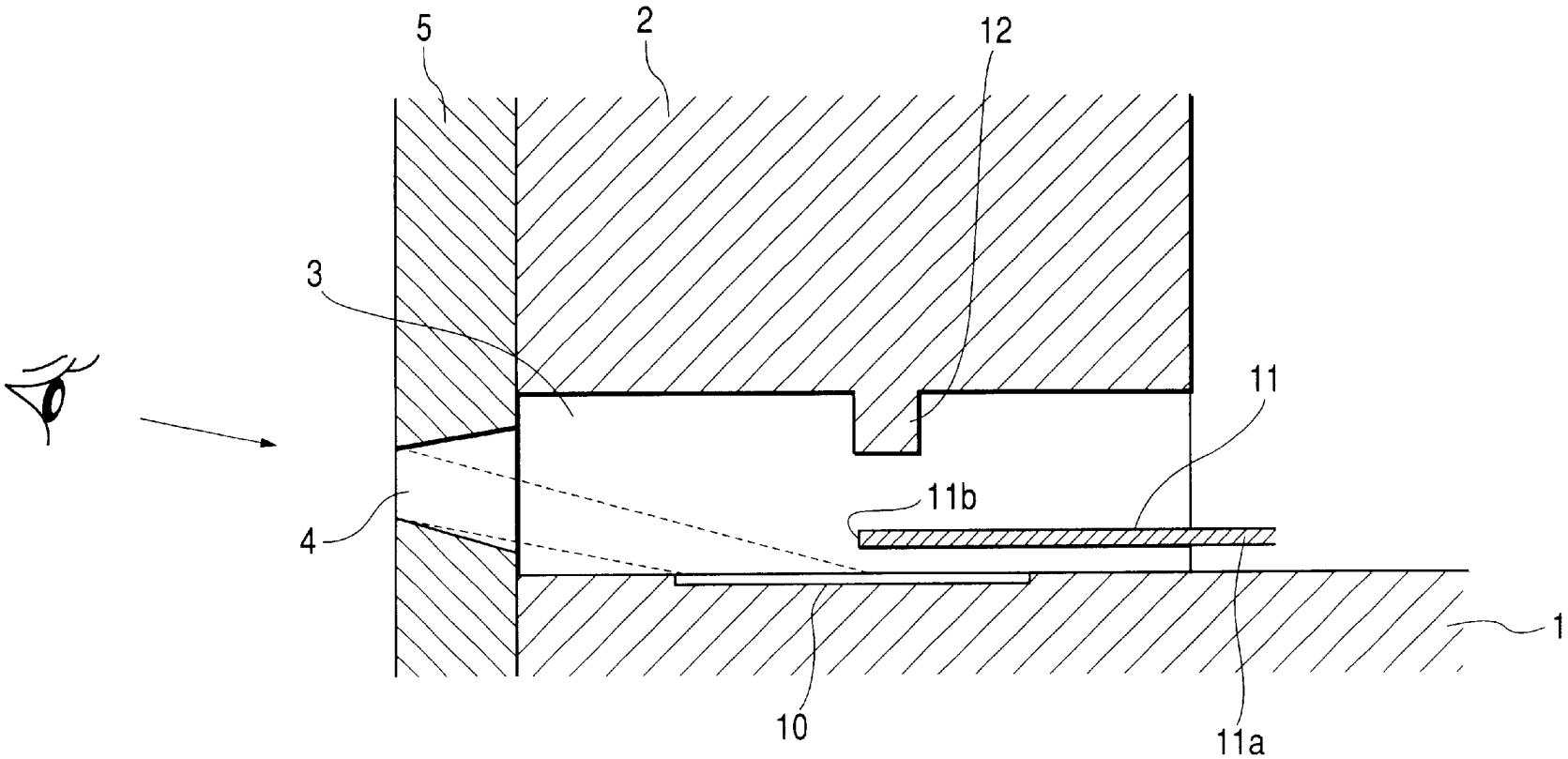
FIG. 4 is a cross-sectional view of a liquid flow path showing linear communication state in the liquid discharge head shown in FIG. 1.

In the present embodiment, there is realized a "linear communication state", namely the flow path is straight for the liquid flow, between the downstream portion of the bubble and the discharge opening 4. More preferably the propagating direction of the pressure wave generated at the bubble formation is made to linearly coincide with the direction of resulting liquid flow and discharge, thereby realizing an ideal state of stabilizing the discharge state of the discharged droplet 66, such as the discharge direction and the discharge velocity thereof, at an extremely high level as will be explained later. In the present embodiment, as a condition for completely or nearly realizing such ideal state, there is adopted a configuration in which the discharge port 4 and the heat generating member 10, particularly the downstream side thereof having influence on the downstream portion of the bubble, are linearly connected. In such configuration, if the liquid is absent in the flow path 3, the heat generating member 10, particularly the downstream side thereof, can be observable from the outside of the discharge port 4 as shown in FIG. 4.

In the following there will be explained the dimensions of the components.

In the present embodiment, as a result of investigation on the turnaround growth of the bubble to the upper face of the movable member, it is found that the turnaround growth of the bubble to the upper face of the movable member can be eliminated and satisfactory discharge characteristics can be obtained by utilizing the relationship between the moving velocity of the movable member and the bubble growing speed (stated differently moving speed of liquid).

More specifically the present embodiment is to eliminate the turnaround growth of the bubble to the upper face of the movable member, thereby obtaining satisfactory discharge characteristics, by limiting the displacement of the movable member by the limiting portion at a point where the volume change rate of the bubble and the displaced volume change rate of the movable member are both increasing.

This feature will be explained in more details with reference to FIGS. 2A to 2E.

Figure 2A:
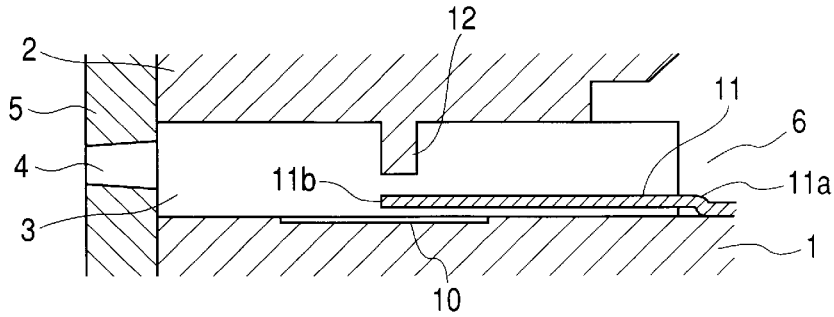
FIGS. 2A, 2B, 2C, 2D and 2E are views showing a single liquid discharge process from the liquid discharge head shown in FIG. 1.
Figure 2B:
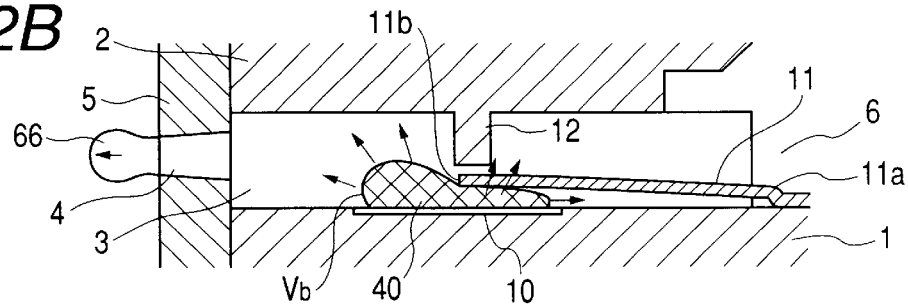

At first, when a bubble is generated on the heat generating member 10 in a state shown in FIG. 2A, a pressure wave is instantaneously generated and the bubble 40 grows by the movement of the liquid around the heat generating member 10 caused by the pressure wave. Initially, the movable member 11 displaces upwards, almost following the liquid movement (FIG. 2B). Then, with the lapse of time, the displacing velocity of the movable member 11 decreases rapidly due to the decreasing inertia of the liquid and the elasticity of the movable member 11. In this state, since the moving speed of the liquid does not decrease much, the difference between the liquid moving speed and the displacing velocity of the movable member 11 increases. If the gap between the movable member 11 (free end 11*b*) and the stopper 12 is still large at this point, the liquid will flow through this gap toward the upstream side of the bubble generating area, thereby generating a state where the movable member 11 cannot easily contact the stopper 12 and losing a part of the discharging power. In such case, therefore, the limiting (intercepting) effect of the movable member 11 by the limiting portion (stopper 12) cannot be fully exploited.

In the present embodiment, therefore, the limiting of the movable member by the limiting portion is executed in a stage where the displacement of the movable member substantially follows the liquid movement. For the purpose of simplicity, the displacing velocity of the movable member and the growing speed of the bubble (liquid moving speed) are represented respectively by "movable member displacement volume change rate" and "bubble volume change rate", which are obtained by differentiating the displaced volume of the movable member and the bubble volume.

Such configuration allows to substantially eliminate a liquid flow inducing the turnaround growth of the bubble to the upper face of the movable member 11 and to securely obtain the closed state of the bubble generating area, thereby realizing satisfactory discharge characteristics.

Also in the present configuration, the bubble 40 continues to grow even after the movable member 11 is limited by the stopper 12, and, in order to stimulate the free growth of the downstream component of the bubble 40, the distance between the stopper portion 12 and the face (upper wall) of the flow path 3 opposed to the substrate 1 (this distance being the protruding height of the stopper 12) is desirably sufficiently large.

In the novel liquid discharge method proposed by the present inventors, the limitation of the displacement of the movable member by the limiting portion means a state where the displacement volume change rate of the movable member becomes 0 or negative.

The flow path 3 has a height of 55 $\mu$m, while the movable member 11 has a thickness of 5 $\mu$m, and the clearance between the lower face of the movable member 11 and the upper surface of the element substrate 1 in the absence of bubble (without displacement of the movable member 11) is 5 $\mu$m.

For the height $t_1$ from the flow path wall on the top plate 2 to the end of the stopper 12 and the clearance $t_2$ between the upper face of the movable member and the end of the stopper 12, stable liquid discharging characteristics could be realized by selecting $t_2$ equal to or smaller than 15 $\mu$m when $t_1$ is equal to or larger than 30 $\mu$m.

In the following there will be explained the single discharge operation of the liquid discharge head of the present embodiment, with reference to FIGS. 2A to 2E and FIG. 3 showing changes in time of the displacement speed and volume of the bubble and changes in time of the displacement velocity and volume of the movable member.

Figure 3:
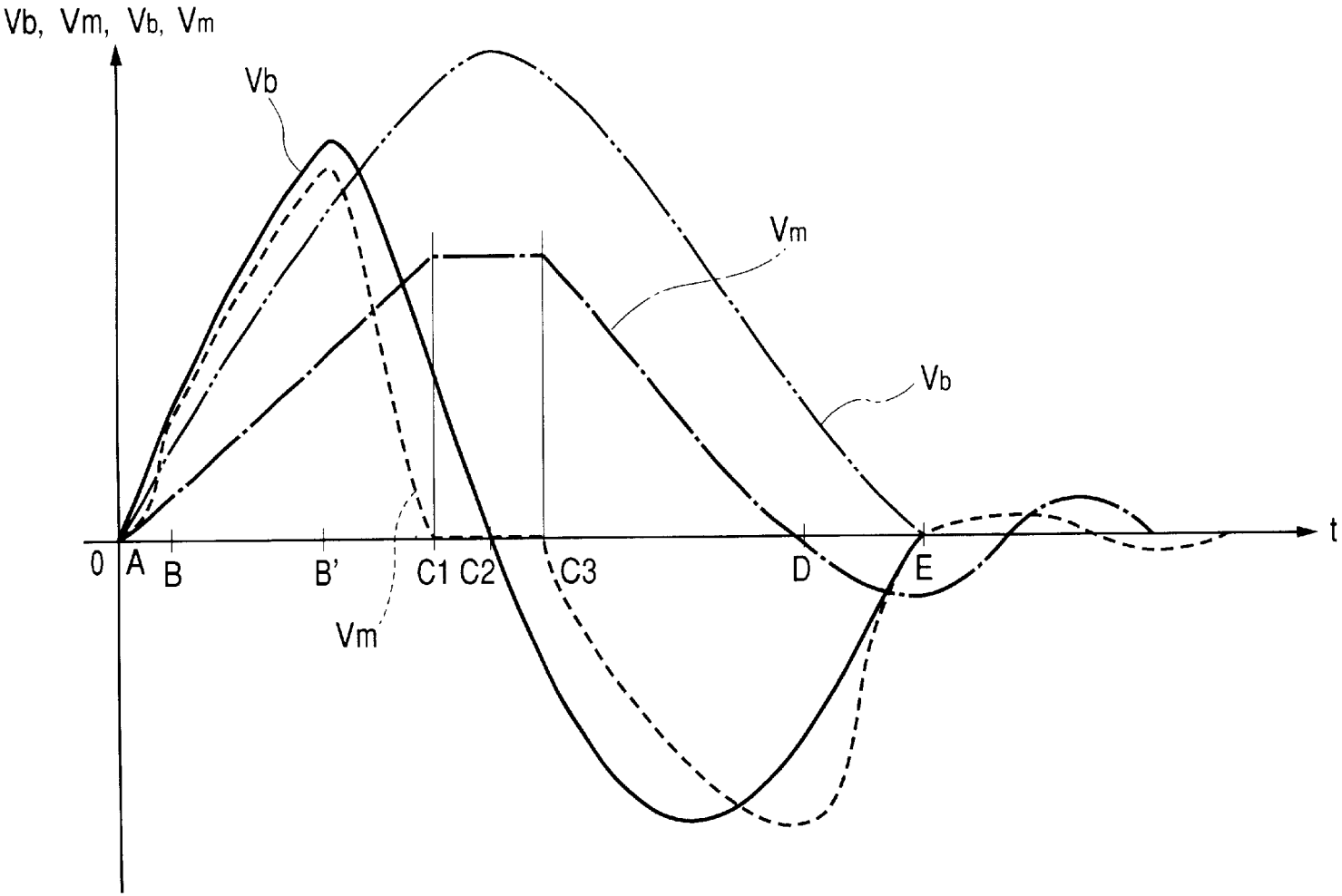
FIG. 3 is a chart showing changes in time of the displacement velocity and volume of the bubble and of the displacement velocity and displacement volume of the movable member, in the discharge process shown in FIGS. 2A to 2E.

In FIG. 3, the bubble volume change rate $v_b$ is represented by a solid line, the bubble volume $V_b$ by a double-dotted chain line, the movable member displacement volume change rate $v_m$ by a broken line, and the movable member displacement volume $V_m$ by a single-dotted chain line. The bubble volume change rate $v_b$ is taken positive when the bubble volume $V_b$ increases; the bubble volume $V_b$ is taken positive when the volume increases; the movable member displacement volume change rate $v_m$ is taken positive when the movable member displacement volume $V_m$ increases; and the movable member displacement volume $V_m$ is taken positive when the volume increases. The movable member displacement volume $V_m$ is taken positive when the movable member 11 displaces from the initial state in FIG. 2A toward the top plate 2, so that it becomes when the movable member 11 from the initial state toward the element substrate 1.

FIG. 2A shows a state prior to the application of energy, such as electric energy, to the heat generating member 10, namely prior to heat generation therein. The movable member 11 is provided, as will be explained later, in an area opposed to the upstream half of the bubble generated by the heat generation of the heat generating member 10.

In FIG. 3, this state corresponds to a point A at a time t=0.

FIG. 2B shows a state in which a part of the liquid in the bubble generating area is heated by the heat generating member 10 whereby the bubble 40 starts to be generated by film boiling. In FIG. 3, this state corresponds to a point B to a position immediately in front of a point $C_1$, wherein the bubble volume $V_b$ increases with time. The displacement of the movable member 11 starts later than the volume change of the bubble 40. More specifically, the pressure wave resulting from the generation of the bubble 40 by the film boiling propagates in the flow path 3 whereby the liquid moves to the downstream and upstream sides from the central area of the bubble generating area, and, in the upstream side, the movable member 11 starts to displace by the liquid flow caused by the growth of the bubble 40. Also the moving liquid in the upstream side passes between the wall of the flow path 3 and the movable member 11 and moves toward the common liquid chamber 6. In this state, the clearance between the stopper 12 and the movable member 11 becomes smaller as the movable member 11 displaces. In this state, the discharged droplet 66 starts to be discharged from the discharge port 4.

Figure 2C:
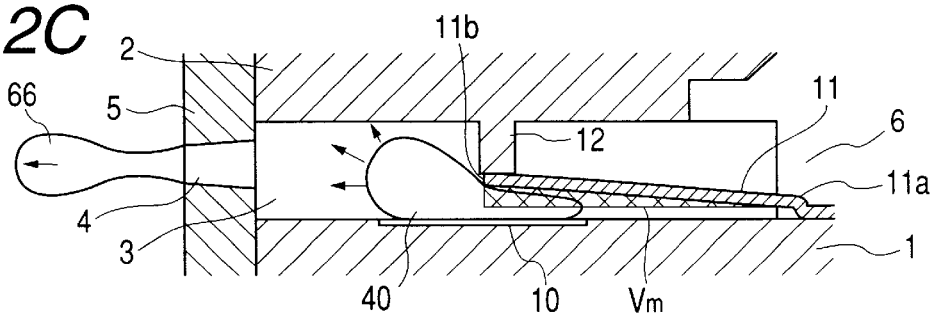

FIG. 2C shows a state where, by the further growth of the bubble 40, the free end 11*b* of the displaced movable member 11 touches the stopper 12. In FIG. 3, this state corresponds to points $C_1$ to $C_3$.

The movable member displacement volume change rate $v_m$ rapidly decreases before the movable member 11 contacts the stopper 12 in the course of transition from a state shown in FIG. 2B to a state shown in FIG. 2C, namely at a point B' in the course of transition from B to $C_1$ in FIG. 3. This is because the liquid flow resistance between the movable member 11 and the stopper 12 rapidly increases immediately before the movable member 11 comes into contact with the stopper 12. Also the bubble volume change rate $v_b$ shows a rapid decrease.

Thereafter the movable member 11 further approaches the stopper 12 and comes into contact therewith, and the mutual contact between the movable member 11 and the stopper 12 is made securer by defining the dimension of the clearance between the upper face of the movable member 11 and the end of the stopper 12 as explained in the foregoing. When the movable member 11 contacts the stopper 12, any further upward displacement is limited ($C_1$ to $C_3$ in FIG. 3), whereby the upstream liquid movement is also significantly limited. At the same time, the growth of the bubble 40 in the upstream direction is also limited by the movable member 11. However, since the liquid has a large moving force in the upstream direction, the movable member 11 receives a strong tensile stress toward the upstream side, thus causing a slight deformation of an upward convex form. In this state the bubble 40 continues growth, but the growth takes plate mainly in the downstream side of the bubble 40 because the growth to the upstream side is limited by the stopper 12 and the movable member 11, whereby the bubble 40 has a larger height at the downstream side of the heat generating member 10 in comparison with the case without the movable member 11. Thus, as shown in FIG. 3, the movable member displacement volume change rate $v_m$ becomes 0 in a range $C_1$ to $C_3$ due to the contact of the movable member 11 with the stopper 12, but the bubble 40 continues growth in the downstream side to a point $C_2$ later than $C_1$ and the bubble volume $V_b$ becomes maximum at this point $C_2$.

On the other hand, since the displacement of the movable member 11 is limited by the stopper 12, the upstream portion of the bubble 40 remains in a small size, bending the movable member 11 in convex form toward the upstream side by the inertial force of the liquid flow toward the upstream side and charging stress therein. In the upstream portion of the bubble 40, the amount intruding into the upstream area is limited to almost zero by the stopper 12, the lateral walls of the flow path, the movable member 11 and the fulcrum 11*a*.

It is thus made possible to significantly limit the liquid flow to the upstream side, to prevent the liquid crosstalk to the adjacent flow path and to prevent the reverse liquid flow and the pressure vibration hindering the high-speed refill in the supply path.

Figure 2D:
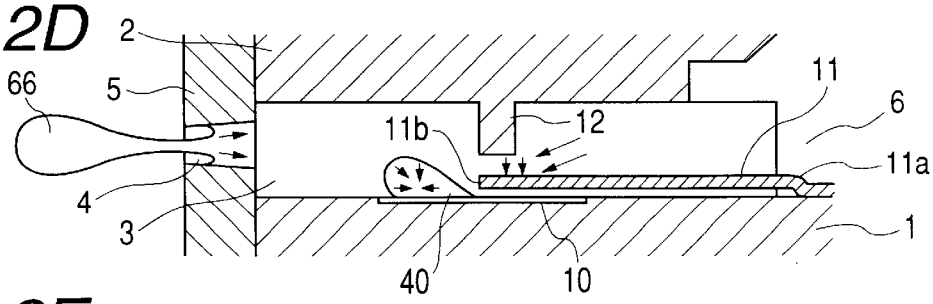

FIG. 2D shows a state where, after the aforementioned film boiling, the internal negative pressure of the bubble 40 overcomes the liquid flow to the downstream side in the flow path 3, whereby the bubble 40 starts to contract.

With the contraction of the bubble 40 ($C_2$ to E in FIG. 3), the movable member 11 displaces downwards ($C_3$ to D in FIG. 3), and the velocity of the downward displacement is enhanced by the stress of the cantilever spring of the movable member 11 itself and the stress of the aforementioned upward convex deformation. A resulting liquid flow to the downstream side, caused in the upstream side of the movable member 11, constituting a low flow resistance area formed between the common liquid chamber 6 and the flow path 3, rapidly becomes a large flow because of the low flow resistance and flows into the flow path 3 through the stopper 12. Through these operations, the liquid at the side of the common liquid chamber 6 is introduced into the flow path 3. The liquid guided into the flow path 3 passes the gap between the stopper 12 and the downward displaced movable member 11 thereby flowing to the downstream side of the heat generating member 10 and also accelerating the extinction of the buble 40 which has not completely vanished. After assisting the bubble extinction, the liquid further flows to the discharge port 4, thereby assisting the restoration of the meniscus and improving the refilling speed.

In this state a liquid rod formed by the droplet 66 discharged from the discharge port 4 becomes a liquid droplet and flies to the exterior. FIG. 2D shows a state where the meniscus is drawn into the discharge port 4 by the vanishing of the bubble and the liquid rod of the droplet 66 is being separated.

Also the aforementioned liquid flow into the flow path 3 through the gap between the movable member 11 and the stopper 12 increases the flow speed at the wall of the top plate 2, so that the microbubbles remain extremely little in this portion and the stability of discharge can be improved.

Also the point of cavitation resulting from the bubble vanishing is displaced to the downstream side of the bubble generating area, whereby the damage to the heat generating member 10 is reduced. At the same time, the kogation on the heat generating member 10 in this area is reduced for the same reason, whereby the stability of discharge can be improved.

Figure 2E:
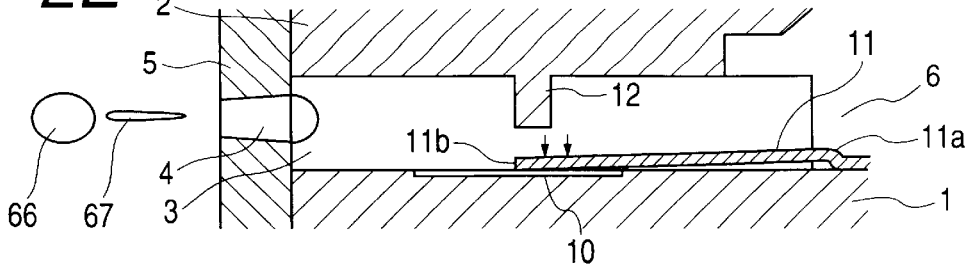

FIG. 2E shows a state where, after the complete extinction of the bubble 40, the movable member 11 displaces with a downward overshooting beyond the initial state (point E and thereafter in FIG. 3).

The overshooting of the movable member 11 rapidly attenuates within a short time, though depending on the rigidity of the movable member 11 and the viscosity of the used liquid, and the movable member 11 returns to the initial state.

FIG. 2E shows a state where the meniscus is considerably drawn to the upstream side by the bubble extinction, but the meniscus returns to the stationary state and is stabilized within a relatively short time, like the attenuation of the displacement of the movable member 11. Also as illustrated in FIG. 2E, behind the discharge droplet 66, there may be formed a satellite 67 by the separation of a trailing portion of the droplet by the surface tension.

Figure 5:
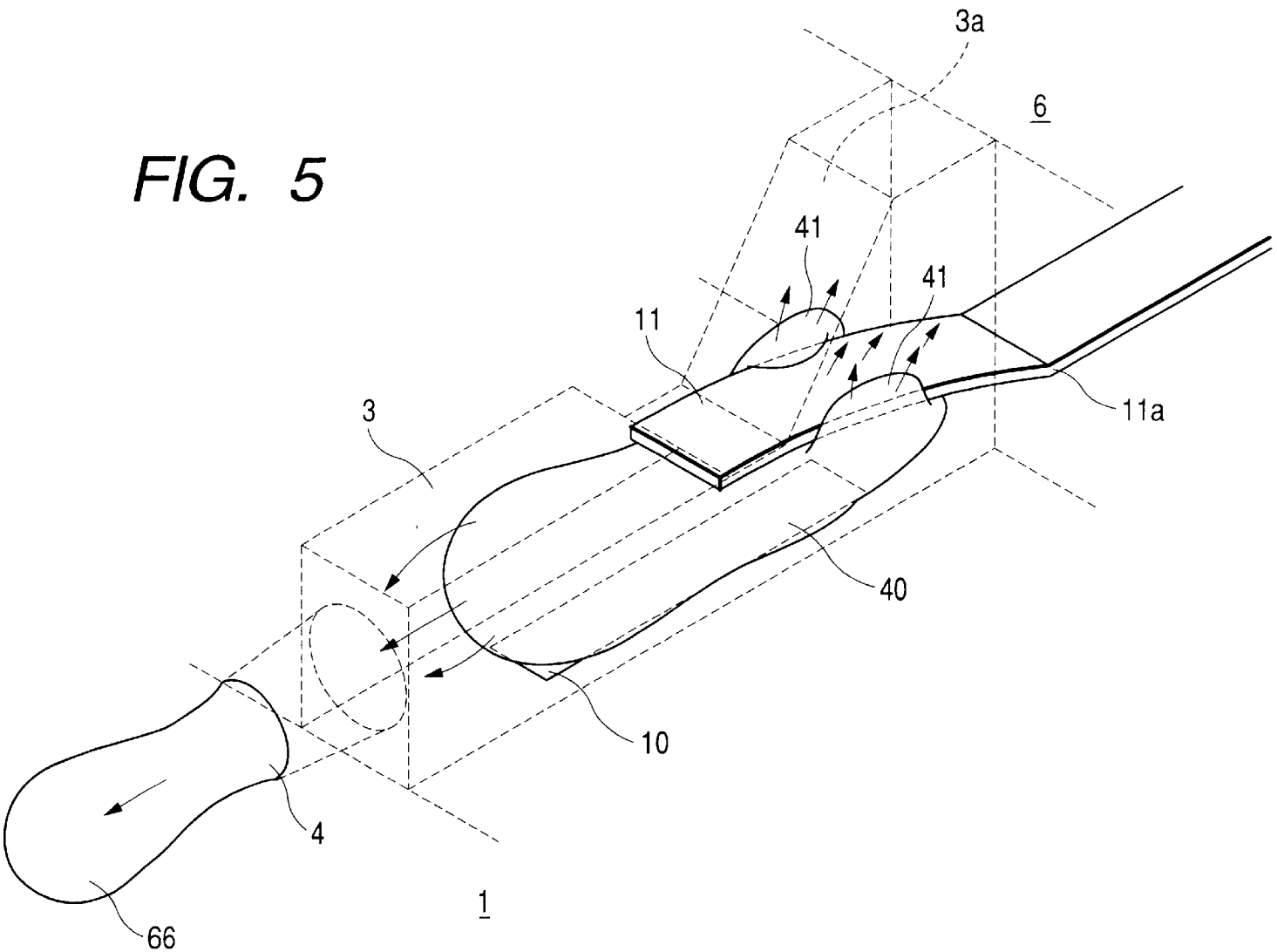
FIG. 5 is a partial perspective view of a head shown in FIG. 1.

Now reference is made to FIG. 5 which is a partial perspective view of the head shown in FIG. 1, for explaining in detail heaving bubbles 41 rising from both sides of the movable member 11 and the liquid meniscus in the discharge port 4. In FIG. 5, the stopper 12 and the low flow resistance area 3*a* at the upstream side of the stopper 12 are different in shape from those shown in FIG. 1 but have similar basic characteristics.

In the present embodiment, small clearances are present between the lateral walls of the flow path 3 and the both sides of the movable member 11, enabling smooth displacement thereof. In the bubble growing process by the heat generating member 10, the bubble 40 not only displaces the movable member 11 but also heaves to the upper face side of the movable member 11 through these clearances, thereby somewhat intruding into the low flow resistance area 3*a*. Such intruding heaved bubbles 41 extend to the rear face (opposite to the bubble generating area) of the movable member 11, thereby suppressing the vibration thereof and stabilizing the discharge characteristics.

Also in the course of vanishing of the bubble 40, the heaved bubbles 41 accelerates the liquid flow from the low flow resistance area 3*a* to the bubble generating area, and promptly completes the vanishing of the bubble, in combination with the aforementioned rapid meniscus retraction from the discharge port 4. In particular, the liquid flow induced by the heaved bubble 41 effectively eliminates the microbubbles remaining in the corner portions of the movable member 11 or the flow path 3.

In the liquid discharge head of the above-described configuration, at the instant when the liquid discharged from the discharge port by the generation of the bubble 40, the droplet 66 is discharged in a state close to a liquid rod having a spherical portion at the leading end. This is same as in the conventional head configuration, but, in the present embodiment, when the movable member 11 displaced by the bubble growing process comes into contact with the stopper 12, the flow path 3 including the bubble generating area constitutes a substantially closed space except for the discharge opeing. Consequently, if the bubble vanishes in this state, the above-mentioned closed space is maintained until the movable member 11 is separated from the stopper 12 by the vanishing of the bubble, so that the bubble vanishing energy mostly functions as a force for moving the liquid in the vicinity of the discharge port 4 in the upstream direction. As a result, immediately after the start of vanishing of the bubble 40, the meniscus is rapidly drawn from the discharge port 4 into the flow path 3 and the trailing portion which is connected to the discharged droplet 66 and constitutes a liquid rod outside the discharge port 4 is rapidly separated from the meniscus by a strong force. Thus the satellite formed from such trailing portion becomes smaller, thus improving the print quality.

Also the discharge speed is not lowered because the trailing portion is not continuously pulled back by the meniscus, and the distance between the droplet 66 and the satellite dot becomes shorter whereby the satellite dot is drawn closer behind the droplet 66 by so-called slipstream phenomenon. As a result, the satellite dot may be united with the discharged droplet 66 and there can be provided a liquid discharge head almost without the satellite dot.

Also in the present embodiment, the aforementioned liquid discharge head is provided with the movable member 11 for the purpose of suppressing only the upstream growth of the bubble 40, with respect to the liquid flow toward the discharge port 4. More preferably the free end 11*b* of the movable member 11 is positioned at the substantial center of the bubble generating area. Such configuration allows to suppress the backward wave and the inertial force of liquid to the upstream side, resulting from the bubble growth but not directly related with the liquid discharge, and to direct the downstream growing component of the bubble 40 straightforward to the discharge port 4.

Also, since the flow resistance is low in the low flow resistance area 3*a* positioned opposite to the discharge port 4 across the stopper 12, the liquid flow to the upstream side by the growth of the bubble 40 becomes a large flow by the presence of the low flow resistance area 3*a*, whereby the movable member 11 receives a stress toward the upstream side when it displaces to contact the stopper 12. As a result, the moving force of the liquid to the upstream side by the bubble growth still remains strongly even if the vanishing of the bubble is started in this state, the aforementioned closed space can be maintained for a certain period until the repulsive force of the movable member 11 overcomes the liquid moving force. Thus the high speed retraction of meniscus can be securely attained by such configuration. Also when the repulsive force of the movable member 11 overcomes the moving force of the liquid to the upstream side by the bubble growth in the course vanishing of the bubble 40, the movable member 11 starts downward displacement toward the initial position, thereby generating a flow to the downstream side also in the low flow resistance area 3*a*. Such downstream flow in the low flow resistance area 3*a* rapidly becomes a large flow because of the low flow resistance and enters the flow path 3 through the stopper 12. As a result, such downstream liquid flow toward the discharge port 4 rapidly decelerates the aforementioned meniscus retraction, thereby promptly terminating the vibration of the meniscus.

The novel liquid discharge method proposed by the present inventors is featured by successive liquid discharges at a high frequency, utilizing the above-described liquid discharge head. Then, reference is made to FIGS. 6A to 6F for explaining the functions in case of successive liquid discharges at a short interval.

Figure 6A:
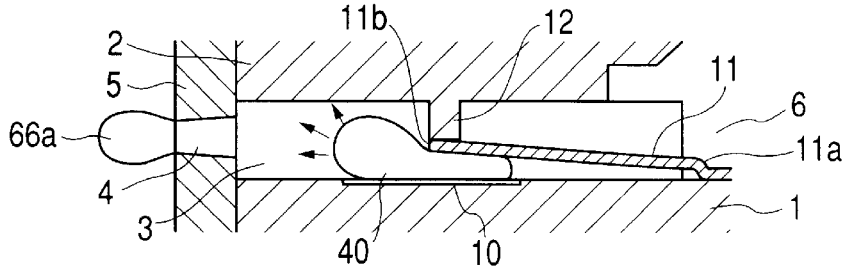
FIGS. 6A, 6B, 6C, 6D, 6E and 6F are schematic cross-sectional views showing different states in continuous liquid discharge with the liquid discharge head shown in FIG. 1.

At first, as shown in FIG. 6A, a first voltage pulse is applied to the heat generating member 10 to generate the bubble 40, thereby forming a first droplet 66*a*. As explained in the foregoing, in the course of bubble generation, the movable member 11 comes into contact with the stopper 12 thereby substantially sealing the upstream side, whereby the liquid movement to the upstream side is significantly limited. Thus the bubble 40 grows larger in the downstream side.

Figure 6B:
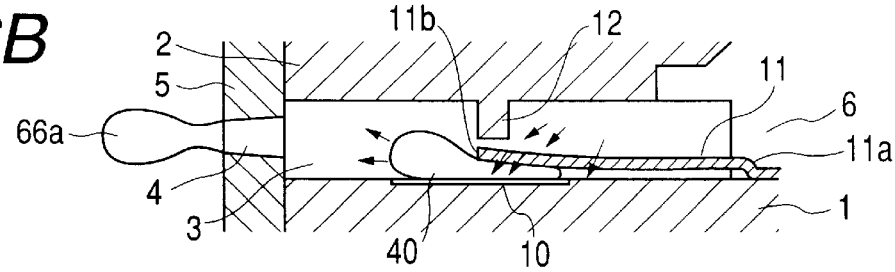

When the bubble 40 starts to contract in this state, as shown in FIG. 6B, the movable member 11 starts to move downward and the liquid refilling is started. As explained in the foregoing, such movement of the movable member 11 accelerates the vanishing of the bubble, particularly in the upstream side of the bubble generating area where the movable member is positioned.

Figure 6C:
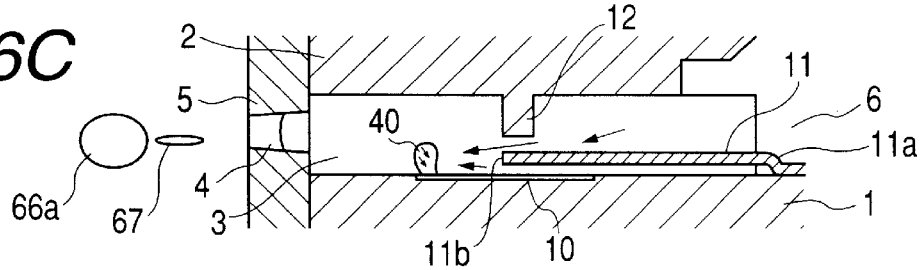

Because the bubble vanishing is accelerated in the upstream side of the bubble generating area and also because the bubble 40 grows larger in the downstream side in the bubble growing process, there is reached a state, in the course of bubble vanishing, where the bubble almost completes vanishing in the upstream side of the bubble generating area but remains at the downstream end portion as shown in FIG. 6C. In this state, the liquid already refilled in the upstream side of the bubble generating area, namely from the center of the heat generating member 10 to the upstream side. Also the meniscus is drawn into the discharge port 4 whereby the first droplet 66*a* and the satellite 67 are separated from the liquid in the liquid discharge head, but, in a state shown in FIG. 6C where the vanishing of the bubble 40 is not yet complete, the meniscus does not reach a state significantly drawn into the discharge port as shown in FIG. 2E but still remains in the vicinity of the liquid discharge plane.

In the liquid discharge method of the present embodiment, a second voltage pulse is applied to the heat generating member 10 to initiate the second bubble generation. In such state, the meniscus is in the vicinity of the liquid discharge plane while the liquid refilling of a certain amount into the upstream side of the heat generating member 10 is already completed, so that satisfactory liquid discharge can be achieved by a voltage pulse application in this state.

Figure 6D:
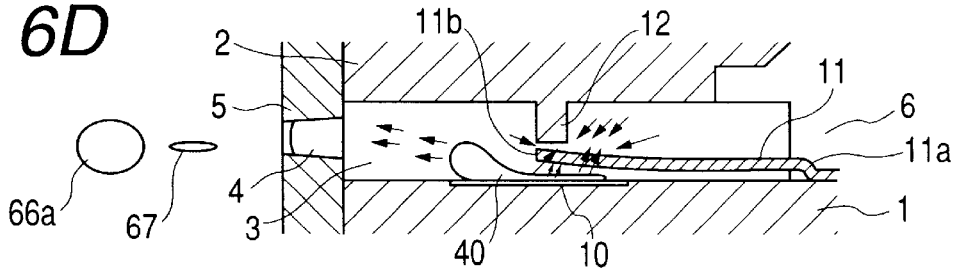

In response to the application of the voltage pulse, the bubble 40 starts to grow and the movable member 11 starts upward displacement as shown in FIG. 6D. At the start of heating in this state, the bubble 40 remains in the upstream side so that the liquid in the vicinity is still in a transient state, and the temperature of the heat generating member 10 is higher in a portion where the bubble remains than in a portion where the bubble vanishing is completed. Therefore the bubble growth proceeds faster than in the first liquid discharge in which the bubble generation is started from the stationary state, so that the bubble can be formed instantly. The meniscus is not drawn as in the single lliquid discharge operation but starts to move to the upstream side as shown in FIG. 6D, from a position shown in FIG. 6C.

Figure 6E:
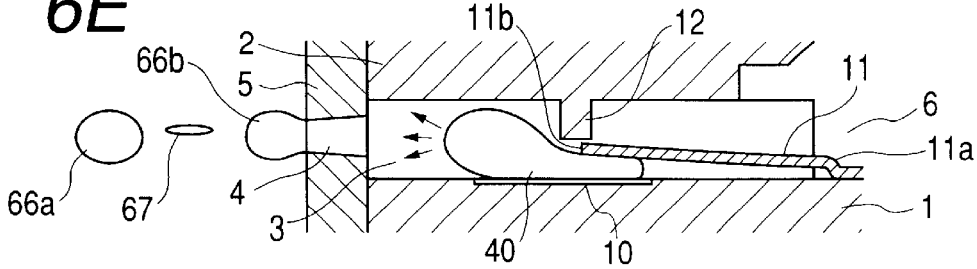
Figure 6F:
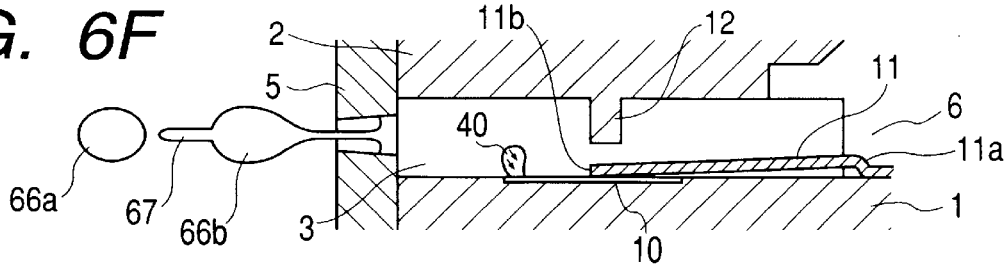

Then the bubble 40 grows further as shown in FIG. 6E to discharge a second droplet 66*b*. In this operation, because of the faster growth of the bubble 40 in comparison with the growth in the first liquid discharge, the bubble volume becomes larger than in the first discharge. Therefore the volume $V_{d2}$ of the second droplet 66*b* can be made larger than the sum of the volume $V_{dm1}$ of the first droplet 66*a* and the volume $V_{ds1}$ of its satellite ($V_{d2}>V_{dm1}+V_{ds1}$).

Also since the second bubble generation is started in a state where a relatively fast liquid flow to the upstream side is generated by the liquid refilling, the second bubble generation cancels the liquid flow from the discharge port 4 toward the heat generating member 10, and, in the formation of the liquid flow to the upstream side, the momentum of the liquid flow from the upstream side of the heat generating member 10 is added to the liquid flow toward the discharge port 10 thereby accelerating the flow. Therefore the velocity $v_2$ of the second droplet 66*b* can be made larger than that $v_1$ of the first droplet 66*a*.

Such condition $v_2>v_1$ can be realized also in case the second droplet 66*b* is larger than the first droplet 66*a* as explained in the foregoing, namely in case $V_{d2}>(V_{dm1}+V_{ds1})$. This fact indicates that a part of the thermal energy generated in the first liquid discharge contributes to the second liquid discharge.

It is also possible that the second droplet 66*b* takes up and is united with the satellite 67 of a liquid rod shape immediately after the separation, namely that the second liquid droplet 66*b* captures the satellite 67. In such case, the volume of the second droplet 66*b* after the capture of the satellite 67 becomes $V_{d2}+V_{ds1}$, and there can naturally be attained a condition $(V_{d2}+V_{ds1})>V_{dm1}$.

By varying the liquid discharge amounts for the first droplet 66*a* and the second droplet 66*b*, the recording may be achieved with a change in the size of the formed pixel or in the gradation levels. Also the difference in the gradation level can be made larger by absorbing the satellite 67 of the first liquid discharge in the second droplet 66*b*. It is furthermore possible to discharge a plurality of droplets in succession and to unite these a plurality of droplets in the course of flight to the recording medium, thereby achieving multilevel recording.

As explained in the foregoing, the liquid discharge method of the present embodiment enables satisfactory liquid discharges in succession with a short interval exceeding the limit of the conventional method, by applying a voltage pulse for the second liquid discharge in a state where the bubble 40 in the course of vanishing after the first liquid discharge still remains in the upstream side of the bubble generating area, thereby enabling to drive the liquid discharge head with a very high frequency. In such operation, the amount of the second liquid discharge can be made larger than that of the first liquid discharge which is started from the stationary state, and the discharge velocity can also be made larger. Also the energy efficiency of discharge can be improved since the a part of the thermal energy generated in the first liquid discharge contributes to the bubble generation at the second liquid discharge.

In the following there will be explained a circuit to be provided on the element substrate of the liquid discharge head shown in FIG. 1.

Figure 7:
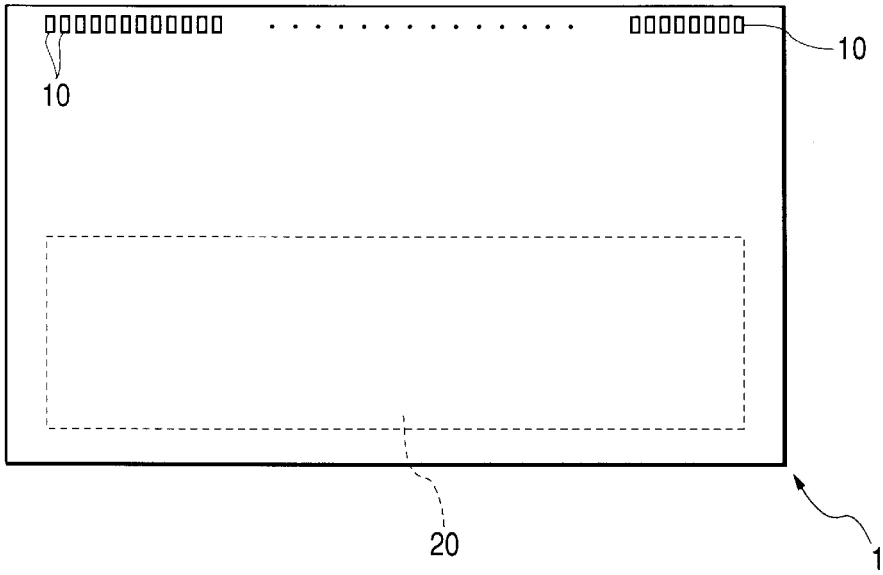
FIG. 7 is a schematic plan view showing the configuration of an element substrate to be employed in the liquid discharge head shown in FIG. 1.

FIG. 7 is a schematic plan view showing the configuration of the element substrate 1, in which the movable member 10 is omitted for the purpose of simplicity.

The element substrate 1 is provided with heat generating members 10 and a circuit portion 20, formed by a thin film process (semiconductor device manufacturing process) on a silicon semiconductor substrate of a substantially rectangular shape. Along a side of the element substrate 1, the heat generating members 10 of a predetermined number (for example 300) are positioned with a predetermined pitch, whereby a heat generating member 10 is positioned in each flow path 3 when the top plate 2 is fixed to the element substrate 1.

On the element substrate 1, a circuit portion 20 is provided in an area exclusing the area of the heat generating members 10 and that of the flow paths 3 (FIG. 1). The circuit portion 20 includes circuits for driving the heat generating members 10 in response to signals from the main body of the liquid discharge apparatus.

Figure 8:
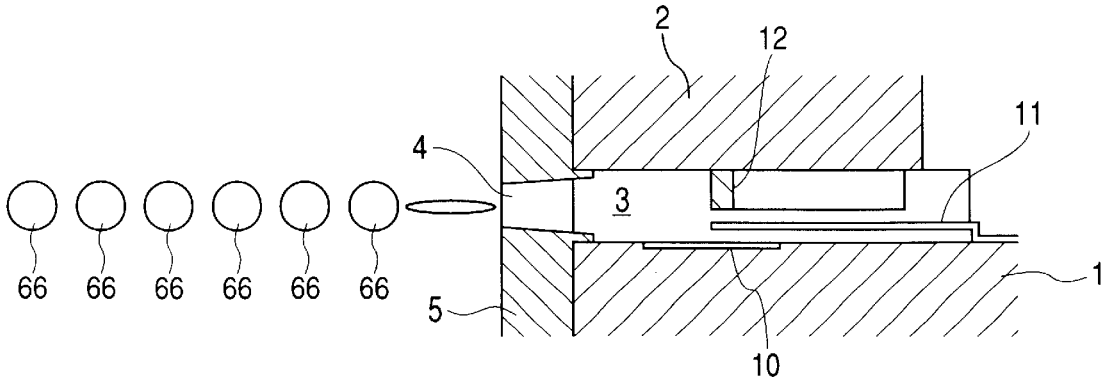
FIG. 8 is a view showing the concept of continuous discharge from the liquid discharge head shown in FIG. 1.
Figure 9:
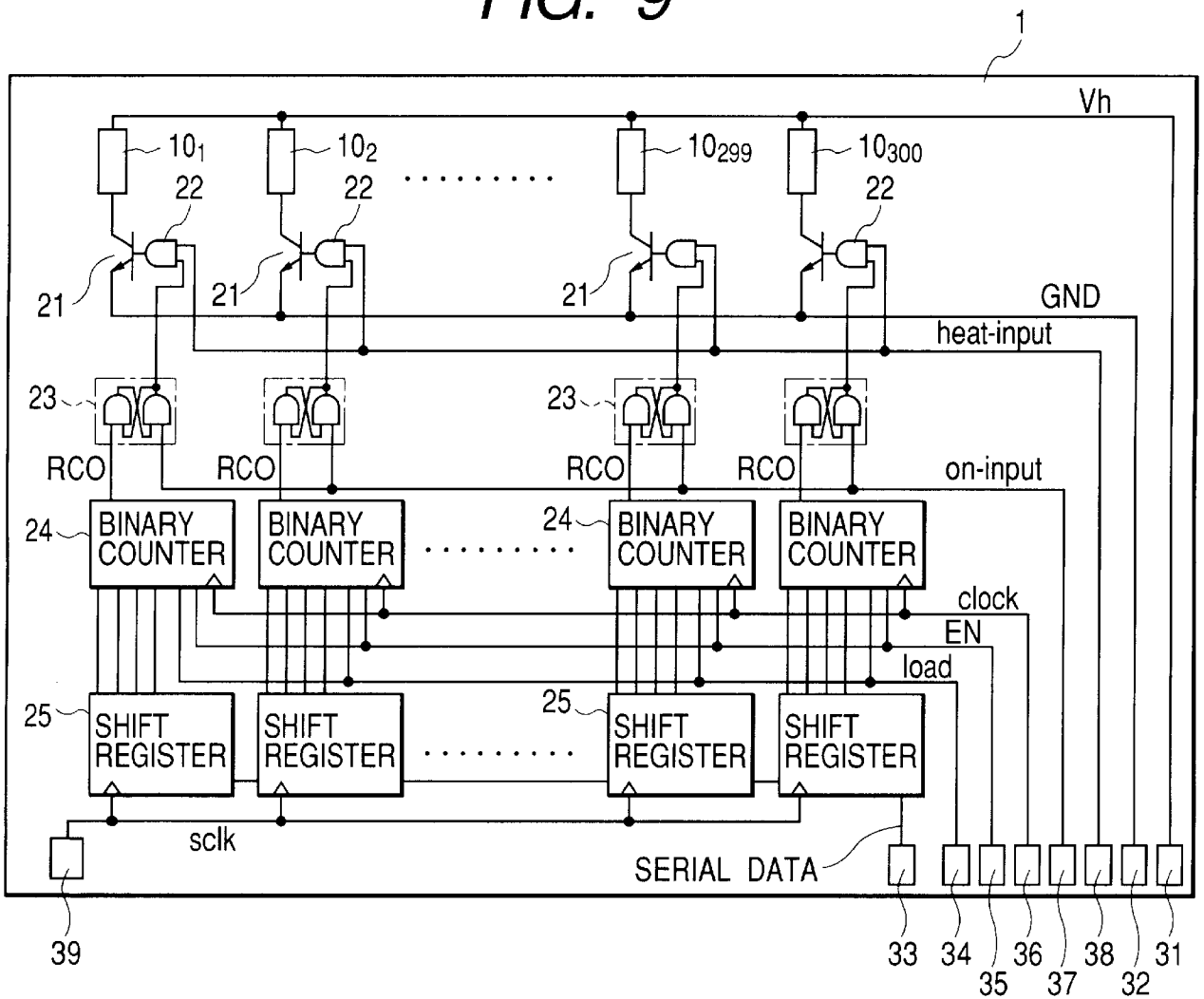
FIG. 9 is a circuit diagram showing a circuit formed on the element substrate.

At first there will be explained a circuit capable of discharging, in succession from the discharge port 4, liquid dropelts of a number corresponding to a signal by driving the heat generating member 10. FIG. 8 shows the concept of continuous discharge. The novel liquid discharge method proposed by the present inventors enables liquid discharges in succession with a very short interval and also enables capture of the satellite of the preceding liquid discharge by the liquid droplet of the succeeding liquid discharge. As a result, there can also be achieved a state shown in FIG. 8 in which the droplets fly in a string before reaching the recording medium. The number of the droplets 66 is same as the number of discharge pulses applied to the heat generating member 10. Therefore, the element substrate 1 is provided with a circuit capable of varying the number of pulses applied in succession to each heat generating member 10. FIG. 9 is a circuit diagram showing the configuration of such circuit.

In FIG. 9, the element substrate 1 is provided with 300 heat generating members $\mathbf{10}_1$ to $\mathbf{10}_{300}$, each of which is composed of an electrothermal converting member for generating heat by a current supply, connected at an end to a common heater power source Vh and at the other end to the collector of a respective switching transistor 21. The emitters of the driving transistors 21 for the respective heat generating members are commonly connected to ground GND.

Figure 10:
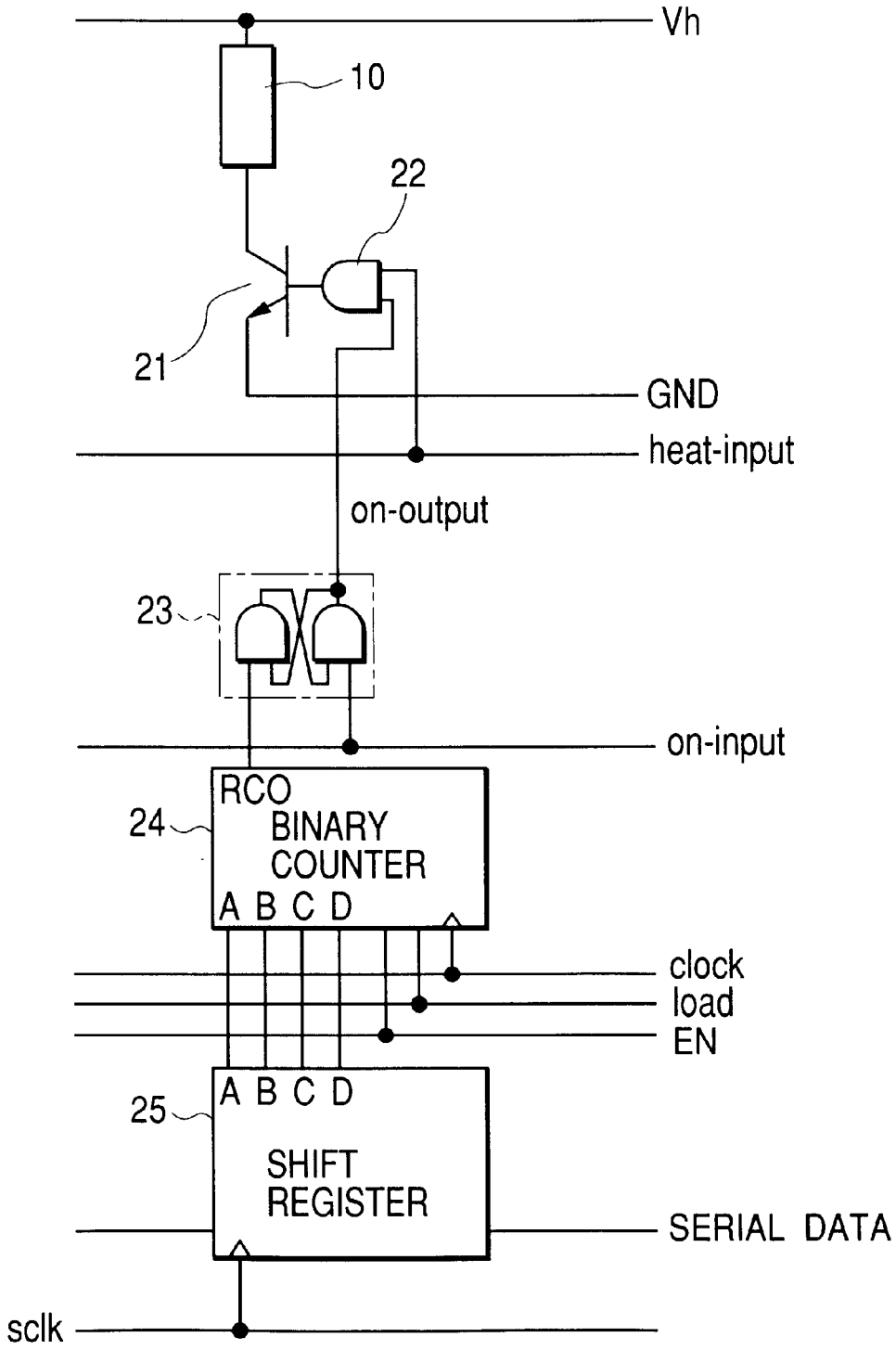
FIG. 10 is a circuit diagram showing a circuit for a heat generating member in the circuit shown in FIG. 9.

FIG. 10 is a circuit diagram relating to a heat generating member 10, extracted from the circuit shown in FIG. 9.

As shown in FIGS. 9 and 10, for each heat generating member 10, there are provided an AND circuit 22 for controlling the gate of the drive transistor 21 for such heat generating member 10, a flip-flop circuit 23 connected to an input port of the AND circuit 22, a synchronized 4-bit binary counter 24 of which a ripple carry output (RCO) is connected to the other input port of the AND circuit 22, and a 4-bit shift register 25 for outputting 4-bit parallel outputs to 4-bit input ports of the binary counter 24. The binary counter 24 can be composed, for example, of SN74AS163 commercially available as a TTL (transistor—transistor logic) circuit or other devices of similar functions, and the shift register 25 can be composed, for example, of SN74AS95 commercially available as a TTL circuit or other devices of similar functions.

The element substrate 1 is also provided with a connection pad 31 receiving the heater power supply Vh, a connection pad 32 constituting a ground GND, a connection pad 33 for receiving print data as serial data, a connection pad 34 for receiving a load signal Load commonly given to the binary counters 24, a connection pad 35 for receiving an enable signal EN commonly given to the binary counters 24, a connection pad 36 for receiving a clock signal Clock commonly given to the binary counters 24, a connection pad 37 for receiving an on-input signal on-input commonly given to the other input ports of the flip-flops 23, a connection pad 38 for receiving a heat pulse heat-input commonly given to the other input ports of the AND circuits 22, and a connection pad 39 for receiving a shift clock signal sclk commonly given to the shift registers 25. The heat pulse heat-input is a reference pulse constituting a reference for a pulse train to be applied to the heat generating member 10. Though not illustrated, there are naturally provided connection pads for power supply and reset signals to the binary counters 24 and the shift registers 25, and those for outputting various monitor signals. These connection pads are connected with the main body of the liquid discharge apparatus through a flexible cable whereby the aforementioned signals and power supplies are given to the element substrate 1 from the main body.

By mutually connecting the shift output and the shift input of the shift registers 25 of the adjacent heat generating members 10, the shift resigers 25 of a number corresponding to the number of the heat generating members 10 are serially connected. In the present example, since there are 300 heat generating members 10, there is constituted a shift register of 1200 (=300×4) bits in total. The serial data entering from the connection pad 33 are supplied to an end of such shift register of 1200 bits.

Figure 11:
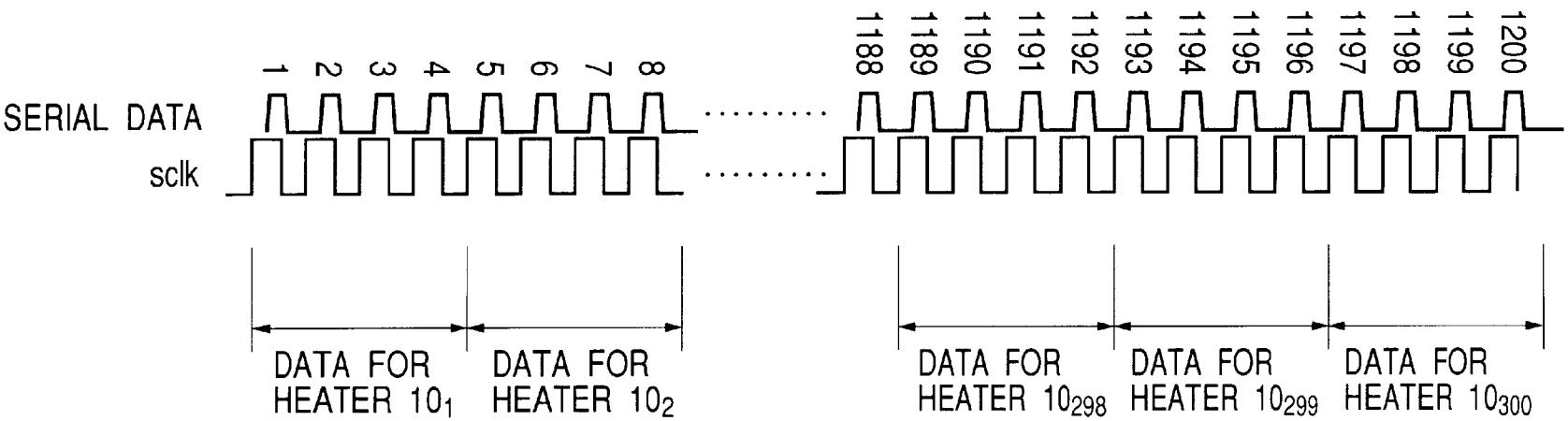
FIG. 11 is a timing chart showing input of serial data to the circuit shown in FIG. 9.

FIG. 11 is a timing chart showing the relationship between the serial data given to the connection pad 33 and the shift clock sclk. The serial data (1 to 1200) of 1200 bits, entered in succession, are shifted at the downshift edge of the shift clock sclk. As a result, the first to 4th bits of the serial data constitute data corresponding to the first heat generating member $\mathbf{10}_1$, the 5th to 8th bits constitute data corresponding to the second heat generating member $\mathbf{10}_2$, . . . , and the 1197th to 1200th bits constitute data corresponding to the 300th heat generating member $\mathbf{10}_{300}$.

Figure 12:
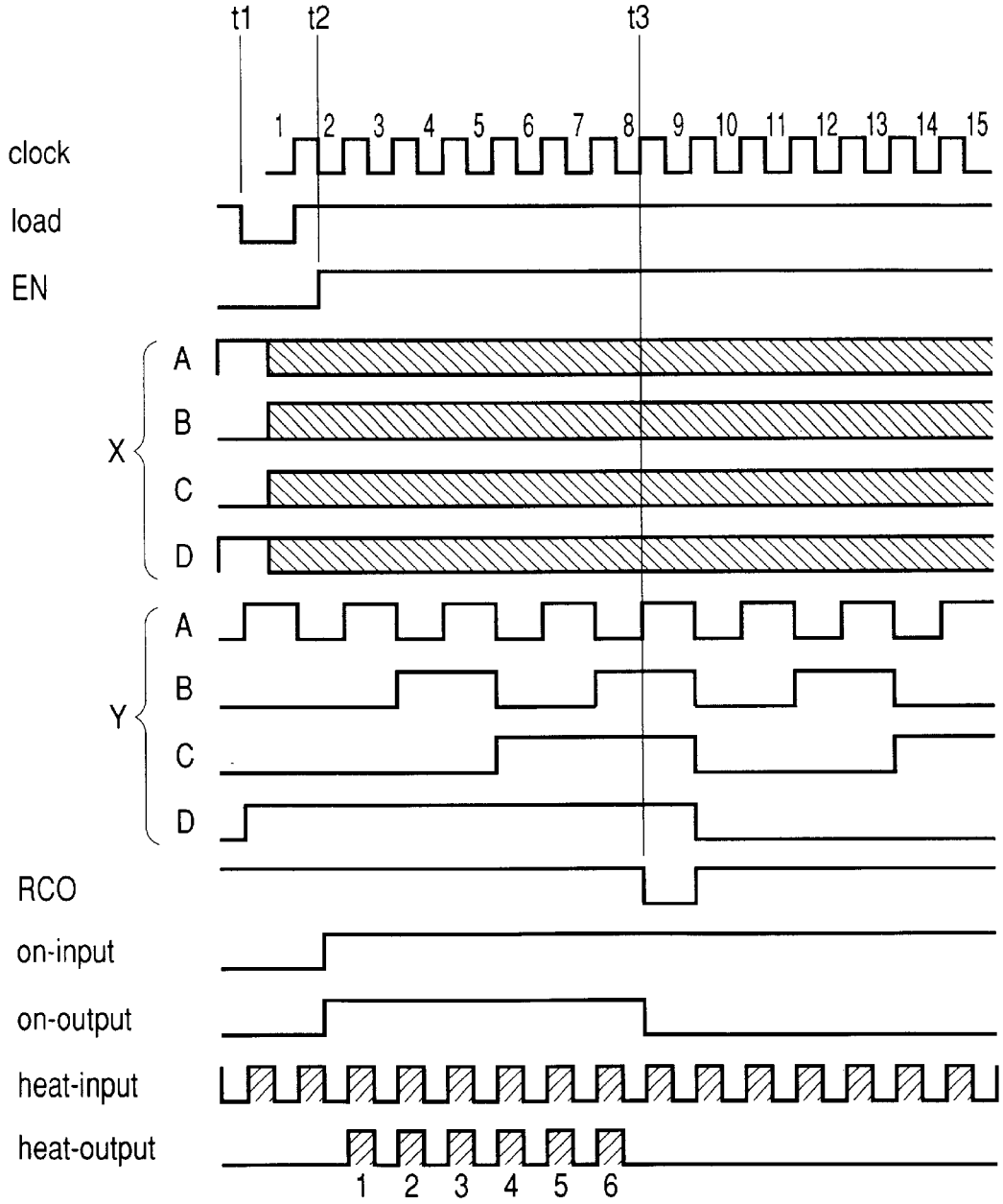
FIG. 12 is a timing chart showing the function of the circuit shown in FIG. 9.

In the following there will be explained, with reference to a timing chart shown in FIG. 12, the function of driving the heat generating member based on the 4-bit data for the corresponding heat generating member, stored in the shift register 25. In FIG. 12, X indicates the input data to the binary counter, and Y indicates the count thereof.

The 4-bit parallel data from the shift register 25 are fetched into the binary counter 24 at the downshift edge (time t1) of the load signal Load. As an example, it is assumed that the 4-bit data fetched into the binary counter 24 are A=1, b=0, C=0 and D=1. The enable signal EN is shifted to a high level state (time t2) whereby the binary counter 24 starts upcounting operation. Then, when a state A=1, B=1, C=1 and D=1 is reached (time t3), the ripple carry output RCO assumes a low level state. On the other hand, the on-input signal is shifted to the high level state when the enable signal EN assumes the high level state (time t2), so that the output signal on-output of the flip-flop 23 assumes a high level state between t2 and t3. As the heat pulse heat-input, namely the reference pulse, has a frequency same as that of the clock signal clock, the output signal heat-output of the AND circuit 22 outputs 6 heat pulses between t2 and t3. As a result, the driving transistor 21 is driven with such 6 pulses whereby the heat generating member 10 is given 6 pulses to discharge 6 droplets 66 in succession from the discharge port 4 as shown in FIG. 8. In the foregoing it is assumed that 6 droplets 66 are discharged, but, as will be apparent from the foregoing description, the interval between t2 and t3 varies according to the 4-bit parallel data loaded into the binary counter 24, so that the number of the droplets discharged in succession can be controlled according to the serial data given to the circuit. In this circuit, the shift register 25 executes an operation of converting serial data into parallel data, and the binary counter 24, flip-flop 23 and AND circuit 22 execute an operation of expanding or decoding the given parallel data to generate pulses of a number based on such data. In this manner the binary counter 24, flip-flop 23 and AND circuit 22 execute an operation of generating drive pulses based on the parallel data, obtained from the serial data. Though not illustrated, it is also possible to generate the drive pulses by a conversion table representing the relationship between the parallel data and the number of the drive pulses, or to utilize the binary counter and the conversion table in combination.

In the configuration shown in FIGS. 9 and 10, a binary counter (or a conversion table) serving as the data decoder is provided at the output side of the 4-bit parallel data from the shift register for each heat generating member. Thus, in case of executing multi-drop recording by sending 16 data per heat generating member in a recording head with 300 heat generating members, it is necessary, in a conventional head, to send and hold 4800 (=300×16) serial data in the shift registers. It is therefore necessary to incorporate a 4800-bit shift register in the chip (element substrate) and a large chip area is required for such shift register. On the other hand, in the configuration shown in FIGS. 9 and 10, a 4-bit data decoder is provided between the shift register and the logic circuit (AND circuit 22 and the flip-flop 23) for on-off control of the transistor for driving the heat generating member, whereby the number of bits of the shift register is reduced to 1200 (=300×4). Thus, even in consideration of the chip area required for the data decoder, there can be achieved a significant reduction in the chip area, thereby increasing the number of the element substrates obtainable from a wafer and also improving the production yield, thus realizing a major cost reduction.

The clock signal clock and the heat pulse signal heat-input have a same frequency but are formed as separate signals, because the clock signal Clock preferably has a duty ratio of 50% for serving as the reference clock for the binary counter 24, while, in the heat pulse signal heat-input, serving as the reference pulse for determining the drive timing of the heat generating member 10, the duty ratio is to be determined in consideration of the optimum shape of the drive pulse for the heat generating member 10. Usually, the duty ratio of the heat pulse signal heat-input is selected considerably smaller than 50%.

FIG. 13 shows the relationship, in the above-described circuit configuration, between the 4-bit data for each heat generating member 10 and the number of droplets discharged in succession from the discharge port. The serially given 4-bit data allow to drive the heat generating member 10 with 0 to 15 pulses.

Since the data fetching into the binary counter 24 is synchronized with the load signal Load, the input of the binary counter 24 may be variable except for such timing of data fetching. Therefore, as long as the correct data are outputted from the shift register 25 at such timing of data fetching, the shift register 25 can be operated independently from the above-explained function of the binary counter 24, and serial data can be given in succession to the shift register 25 in parallel manner to the liquid discharges in succession. In the present circuit configuration, since the 0 to 15 consecutive pulses for each of 300 heat generating members are represented by 1200 bits in total, the serial data of such 1200 bits can be fed within a time of 150 μs if the maximum drive frequency of the liquid discharge head is 100 kHz (corresponding to a drive interval of 10 μs). It corresponds to a data transfer rate of 8 MHz, Since there is required a transfer rate of 30 MHz in case of simple serial transfer of the data, whether or not to drive each of 300 heat generating members, within a driving interval of 10 μs, the present configuration achieves a reduction of the transfer rate to about ¼. On the other hand, if the data transfer rate can be allowed to 32 MHz, there can be realized a drive at 400 kHz.

If the data transfer rate is increased to about 30 MHz in the conventional technology, there may result an abnormal wave form (particularly in the heat pulse) by the influence of noise or a large radiation noise, causing a detrimental influence on the external electronic devices, and there cannot be avoided the drawbacks such as failure in the liquid discharge or deterioration in the image quality. In contrast, the present invention enables highly precise multi-dot recording of a high driving frequency, with a low data transfer rate.

In the liquid discharge head explained in FIGS. 1 to 6A through 6F, if driven with a frequency equal to or higher than 30 kHz, there will result a phenomenon that the flying droplets land (displace) integrally. Therefore, there can be obtained a dot-modulated image with extremely good landing accuracy by driving the liquid discharge head with the above-described circuit. However, the circuit formed on the element substrate 1 and explained in FIGS. 9 to 13 is usable not only in the liquid discharge head shown in FIGS. 1 to 6A through 6F but also in the conventional liquid discharge heads such as a head not provided with the movable member or a head provided with the movable member but not with the limiting portion for limiting the displacement of the movable member. Also in case of applying the above-described circuit to the conventional liquid discharge head, there can be obtained an advantage of reducing the data transfer rate, since the number of droplets discharged in succession can be designated with a fewer number of bits.

The above-described configuration is to provide each heat generating member with input data of at least 2 bits, and to generate, utilizing a conversion table or the like, the drive pulses of a number larger than the number of bits of such input data at least for a specified set of input data. Conventionally the drive pulses are generated in the main body of the liquid discharge apparatus and are transmitted to the head, but, in the present embodiment, a data processing circuit such as a conversion table or a binary counter is incorporated in the element substrate, namely in the liquid discharge head, thereby reducing the burden of data processing in the main body of the apparatus and enabling multi-dot recording of a high drive frequency with a low data transfer rate.

In the foregoing description, the heat pulse signal heat-input is supplied to the element substrate 1 from the exterior, but it is also possible to provide the element substrate 1 with an oscillation circuit for generating the heat pulse heat-input. In such case the pulse wave form does not become blunt in the transmission system from the exterior, so that the heat pulse heat-input can have an extremely precise wave form thereby stabilizing the discharge characteristics.

Also the number of bits per heat generating member 10 is not limited to 4. For example data of 3 bits per heat generating member 10 can generate 0 to 7 droplets discharged in succession, and data of 2 bits per heat generating member can generate 0 to 3 droplets. Also data of 5 bits per heat generating member can generate 0 to 31 droplets discharged in succession.

Figure 14:
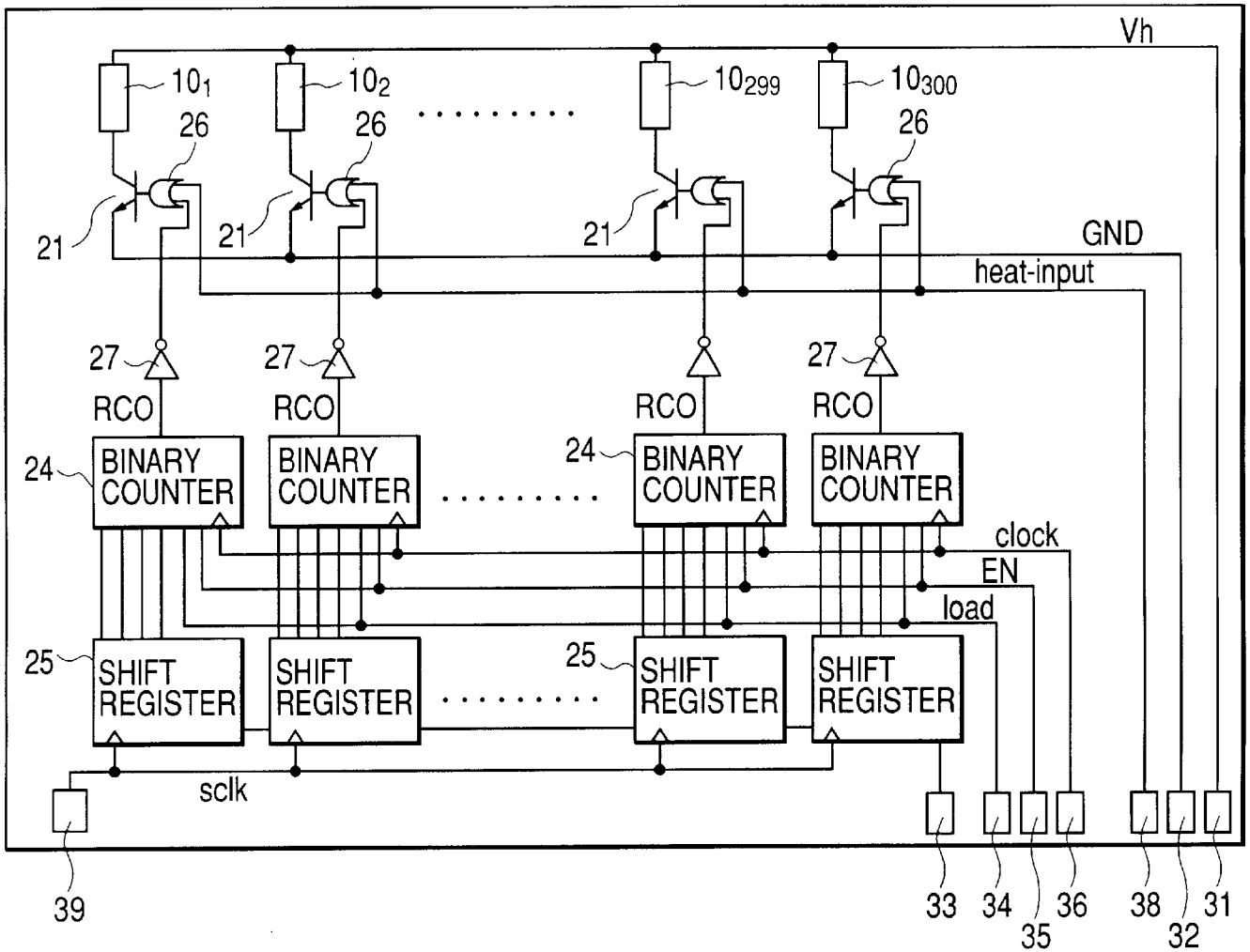
FIG. 14 is a circuit diagram showing another example of the circuit formed on the element substrate.

In the following there will be explained a circuit configuration for varying the interval between two discharge pulses. FIG. 14 is a circuit diagram showing a circuit to be formed on the element substrate 1 in such case, and FIG. 15 is a circuit diagram corresponding to a heat generating member within the circuit shown in FIG. 14.

Figure 15:
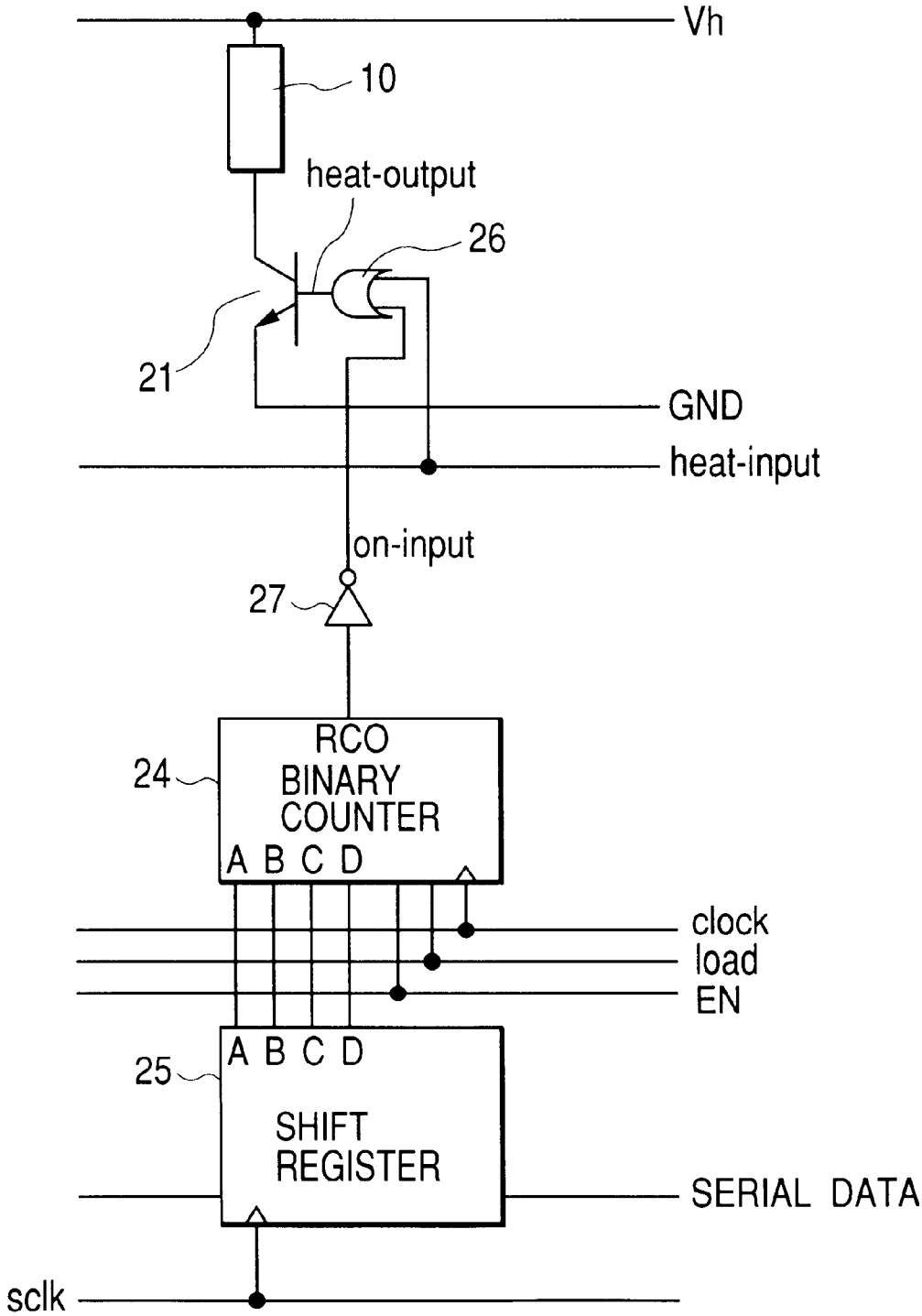
FIG. 15 is a circuit diagram showing a circuit for a heat generating member in the circuit shown in FIG. 14.

The circuit shown in FIGS. 14 and 15 is similar to that shown in FIGS. 9 and 10, but the AND circuit connected to the base of the driving transistor 21 is replaced by an OR circuit 26, and the flip-flop is replaced by an inverter 27. The inverter 27 inverts the ripple carry output RCO of the binary counter 24 to obtain an on-input signal for supply to an input port of the OR circuit 26. The on-input signal is given to the OR circuit 26 for each heat generating member 10. Consequently this circuit does not require the externally supplied on-input signal, so that the connection pad 37 shown in FIG. 9 is not provided in the circuit shown in FIG. 14. The circuit shown in FIGS. 14 and 15 is same as that shown in FIGS. 9 and 10 in other aspects.

Figure 16:
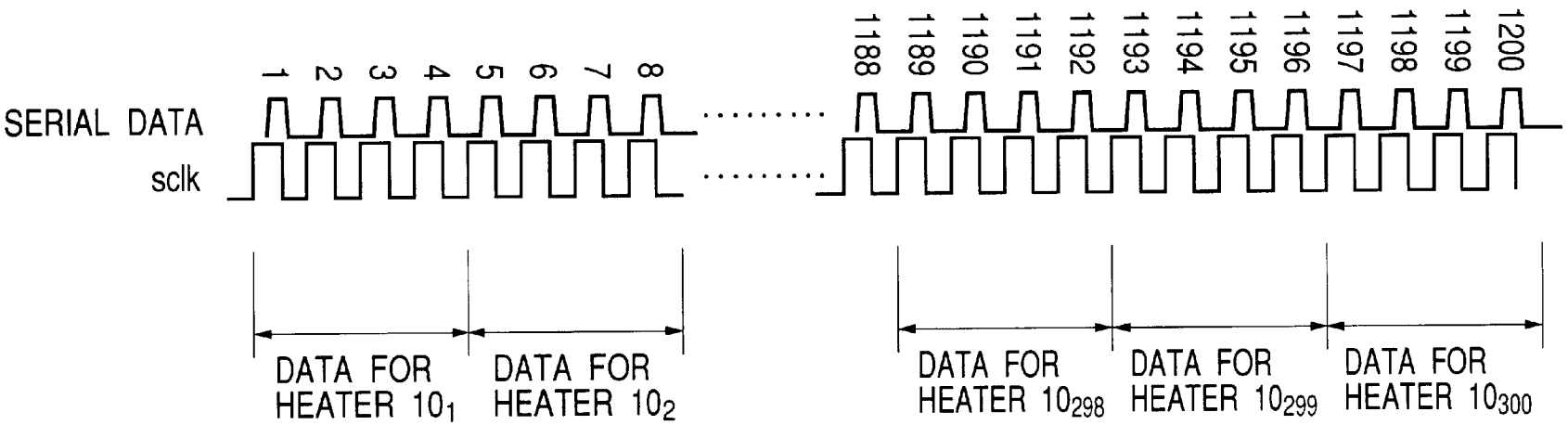
FIG. 16 is a timing chart showing input of serial data to the circuit shown in FIG. 14.

Also in the circuit shown in FIGS. 14 and 15, the data for the 300 heat generating members $\mathbf{10}_1$ to $\mathbf{10}_{300}$ are given to the connection pad 33 as serial data of 1200 bits. FIG. 16 is a timing chart showing the relationship between such serial data and the shift clock sclk. As will be apparent from FIG. 16, the correspondence between each bit in the serial data and the heat generating member is same as that shown in FIG. 11.

Figure 17:
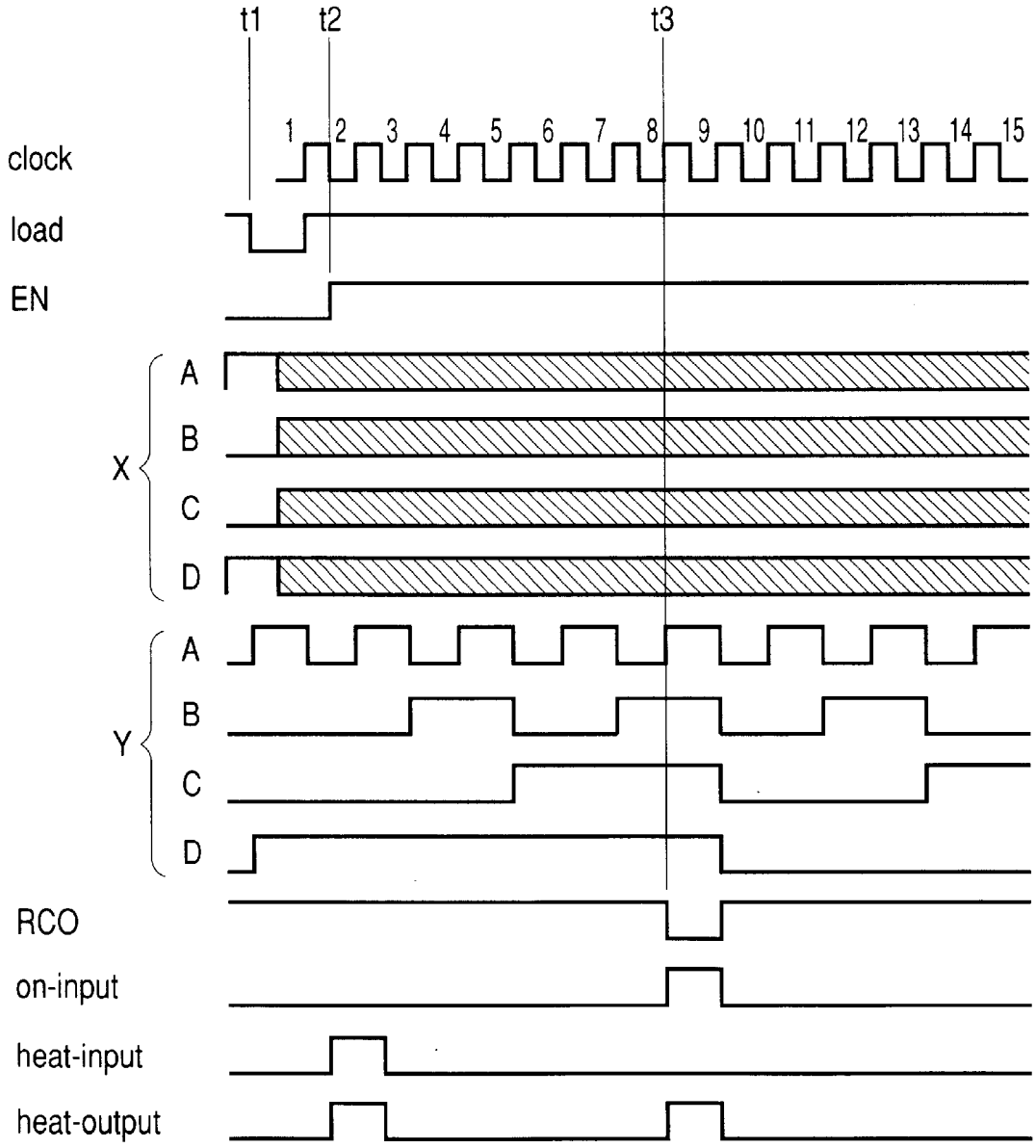
FIG. 17 is a timing chart showing the function of the circuit shown in FIG. 14.

In the following there will be explained, with reference to a timing chart shown in FIG. 17, the function of driving the heat generating member based on the 4-bit data for the corresponding heat generating member, stored in the shift register 25. In FIG. 17, X indicates the input data to the binary counter, and Y indicates the count thereof.

The 4-bit parallel data from the shift register 25 are fetched into the binary counter 24 at the downshift edge (time t1) of the load signal Load. As an example, it is assumed that the 4-bit data fetched into the binary counter 24 are A=1, B=0, C=0 and D=1. The enable signal EN is shifted to a high level state (time t2) whereby the binary counter 24 starts upcounting operation. Then, when a state A=1, B=1, C=1 and D=1 is reached (time t3), the ripple carry output RCO assumes a low level state. On the other hand, the on-input signal is shifted to the high level state when the enable signal EN assumes the high level state (time t2), so that the output signal on-output of the inverter 27 assumes a high level state between t2 and t3.

In this circuit, the timing of the heat pulse heat-input supplied from the main body of the liquid discharge apparatus is different from that in the circuit shown in FIGS. 9 and 10. More specifically, the heat pulse heat-input is supplied as a single pulse of a predetermined pulse duration, upshifted from the upshift (t2) of the enable signal EEN. As the OR circuit 26 receives such heat pulse hat-input and the on-input signal obtained by inverting the ripple carry output signal RCO by the inverter 27, the output signal heat-output of the AND circuit 22 consists of two pulses, namely a pulse starting at t2 (corresponding to the heat pulse heat-input) and a pulse starting at t3 (ripple carry output signal RCO). The duration of the pulse starting at t3 is equal to the cycle time of the clock signal Clock. As will be apparent from the foregoing, the interval between t2 and t3 varies according to the 4-bit data loaded in the binary counter 24, so that the interval of these two pulses can be varied by varying the data supplied as serial data to this circuit whereby the interval of the two droplets discharged in succession from the discharge port can be controlled. In this circuit, the shift register 25 executes an operation of converting serial data into parallel data, and the binary counter 24, inverter 27 and OR circuit 26 execute an operation of expanding the given parallel data and setting the inverval of the pulses based on the parallel data.

FIG. 18 shows the relationship, in the above-described circuit configuration, between the 4-bit data for each heat generating member 10 and the interval of the two droplets discharged from the discharge port. The unit of time is a cycle time of the clock signal. In case data A=B=C=D=1 are given, the ripple carry output signal RCO is outputted at the loading of such data, so that the number of droplet becomes 1 only in this case.

The circuit formed on the element substrate 1 and explained in FIGS. 14 to 18 is suitable for use in the liquid discharge head explained in FIGS. 1 to 6A through 6F, but is also usable in the conventional liquid discharge heads such as a head not provided with the movable member or a head provided with the movable member but not with the limiting portion for limiting the displacement of the movable member. Also in case of applying the above-described circuit to the conventional liquid discharge head, there can be designated the intervqal of the two droplets discharged in succession in more detailed manner with a fewer number of bits.

Also the number of bits per heat generating member 10 is not limited to 4. For example data of 3 bits per heat generating member 10 can control the interval of the two discharged droplets in 7 levels, while data of 2 bits can achieve control in 3 levels, and data of 5 bits can achieve control in 31 levels.

The preferred element substrate based on the present invention is not limited that shown in FIG. 9 or 14. The circuit shown in FIG. 9 is to supply the element substrate with heat pulses heat-input of a frequency same as (but different in duty ratio) the clock signal, to extract, from the heat pulses heat-input, pulses of a number designated by the 4-bit serial data of the ripple carry output RCO from the binary counter and to drive the heat generating member 10 based on the extracted pulses heat-output. Thus, in the circuit shown in FIG. 9, the heat pulses selected by the data processing on the element substrate 1 are given to the element substrate from the exterior. However, it is also possible to generate the heat pulses heat-input on the element substrate 1.

Figure 19:
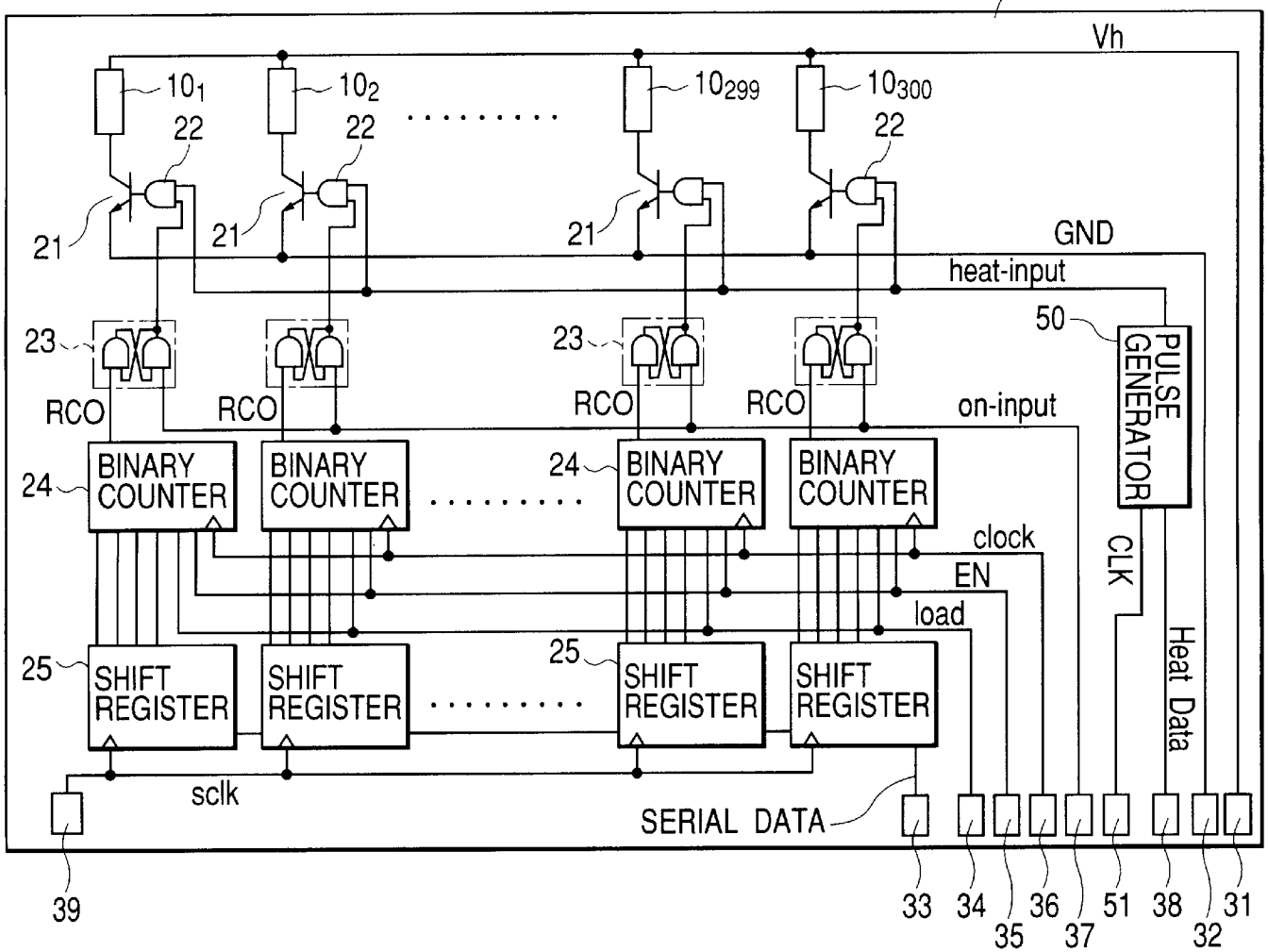
FIG. 19 is a circuit diagram showing still another example of the circuit formed on the element substrate.

An element substrate shown in FIG. 19 is different from that shown in FIG. 9 in that a pulse generator 50 for generating the heat pulse heat-input is incorporated in the element substrate 1. The element substrate 1 is provided, as shown in FIG. 7, with heat generating members 10 and a circuit portion 20, formed by a thin film process (semiconductor device manufacturing process) on a silicon semiconductor substrate of a substantially rectangular shape. Along a side of the element substrate 1, the heat generating members 10 of a predetermined number (for example 300) are positioned with a predetermined pitch, whereby a heat generating member 10 is positioned in each flow path 3 when the top plate 2 is fixed to the element substrate 1.

In FIG. 19, the element substrate 1 is provided with 300 heat generating members $\mathbf{10}_1$ to $\mathbf{10}_{300}$, each of which is composed of an electrothermal converting member for generating heat by a current supply, connected at an end to a common heater power source Vh and at the other end to the collector of a respective switching transistor 21. The emitters of the driving transistors 21 for the respective heat generating members are commonly connected to ground GND. A pulse generator 50, provided commonly to the heat generating members $\mathbf{10}_1$ to $\mathbf{10}_{300}$, receives a clock signal CLK and a heat signal Heat Data from the main body of the liquid discharge apparatus and generates heat pulses Heat-input for the heat generating members.

Figure 20:
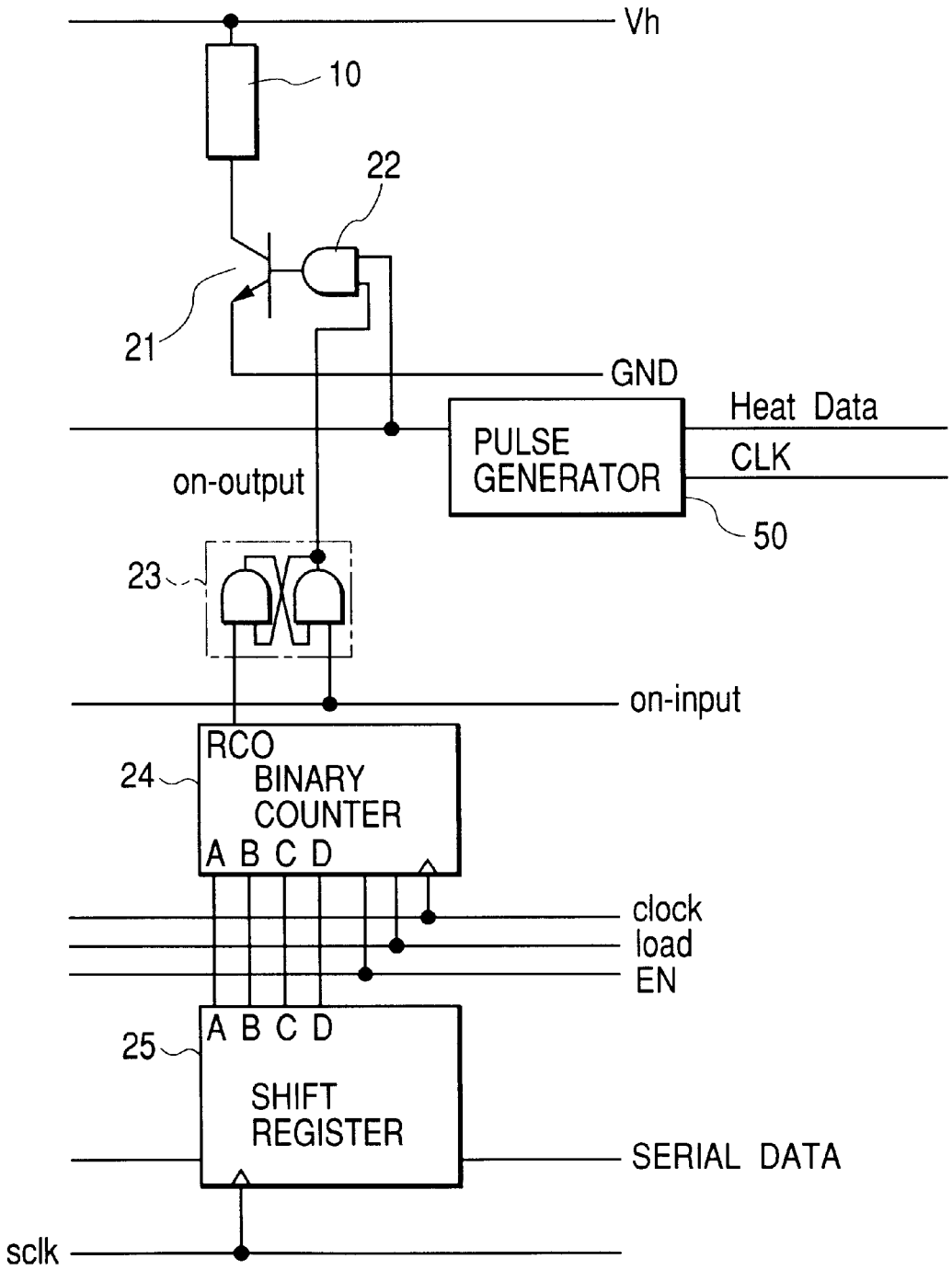
FIG. 20 is a circuit diagram showing a circuit for a heat generating member in the circuit shown in FIG. 19.

FIG. 20 is a circuit diagram relating to a heat generating member 10, extracted from the circuit shown in FIG. 19.

As shown in FIGS. 19 and 20, for each heat generating member 10, there are provided an AND circuit 22 for controlling the gate of the drive transistor 21 for such heat generating member 10, a flip-flop circuit 23 connected an input port of the AND circuit 22, a synchronized 4-bit binary counter 24 of which a ripple carry output (RCO) is connected to an input port of the flip-flop 23, and a 4-bit shift register 25 for outputting 4-bit parallel data to 4-bit input ports of the binary counter 24. The other input port of the AND circuit 22 receives the heat pulse Heat-input from the pulse generator 50. The binary counter 24 can be composed, for example, of SN74AS163 commercially available as a TTL circuit or other devices of similar functions, and the shift register 25 can be composed, for example, of SN74AS95 commercially available as a TTL circuit or other devices of similar functions.

The element substrate 1 is also provided, as in the circuit shown in FIG. 9, with a connection pad 31 receiving the heater power supply Vh, a connection pad 32 constituting a ground GND, a connection pad 33 for receiving print data as serial data, a connection pad 34 for receiving a load signal Load, a connection pad 35 for receiving an enable signal EN, a connection pad 36 for receiving a clock signal Clock, a connection pad 37 for receiving an on-input signal On-input, and a connection pad 39 for receiving a shift clock signal sclk. A connection pad 38 receives a heat signal Heat Data given to the pulse generator 50 from the main body of the liquid discharge apparatus. Also there is provided a connection pad 51 for receiving a clock signal CLK given to the pulse generator 50. In the illustrated example, as will be shown in a following timing chart (FIG. 21), the clock signal CLK supplied to the connection pad 51 is same as the clock signal Clock supplied to the connection pad 36, but these clock signals may also be mutually different. Though not illustrated, there are naturally provided connection pads for power supply and reset signals to the binary counters 24 and the shift registers 25, and those for outputting various monitor signals. These connection pads are connected with the main body of the liquid discharge apparatus through a flexible cable whereby the aforementioned signals and power supplies are given to the element substrate 1 from the main body. By mutual connection as in FIG. 9, the shift resigers 25 of a number corresponding to the number of the heat generating members 10 are serially connected. In the present example, the relationship between the serial data given to the connection pad 33 and the shift clock sclk is represented by a timing chart shown in FIG. 11.

Figure 21:
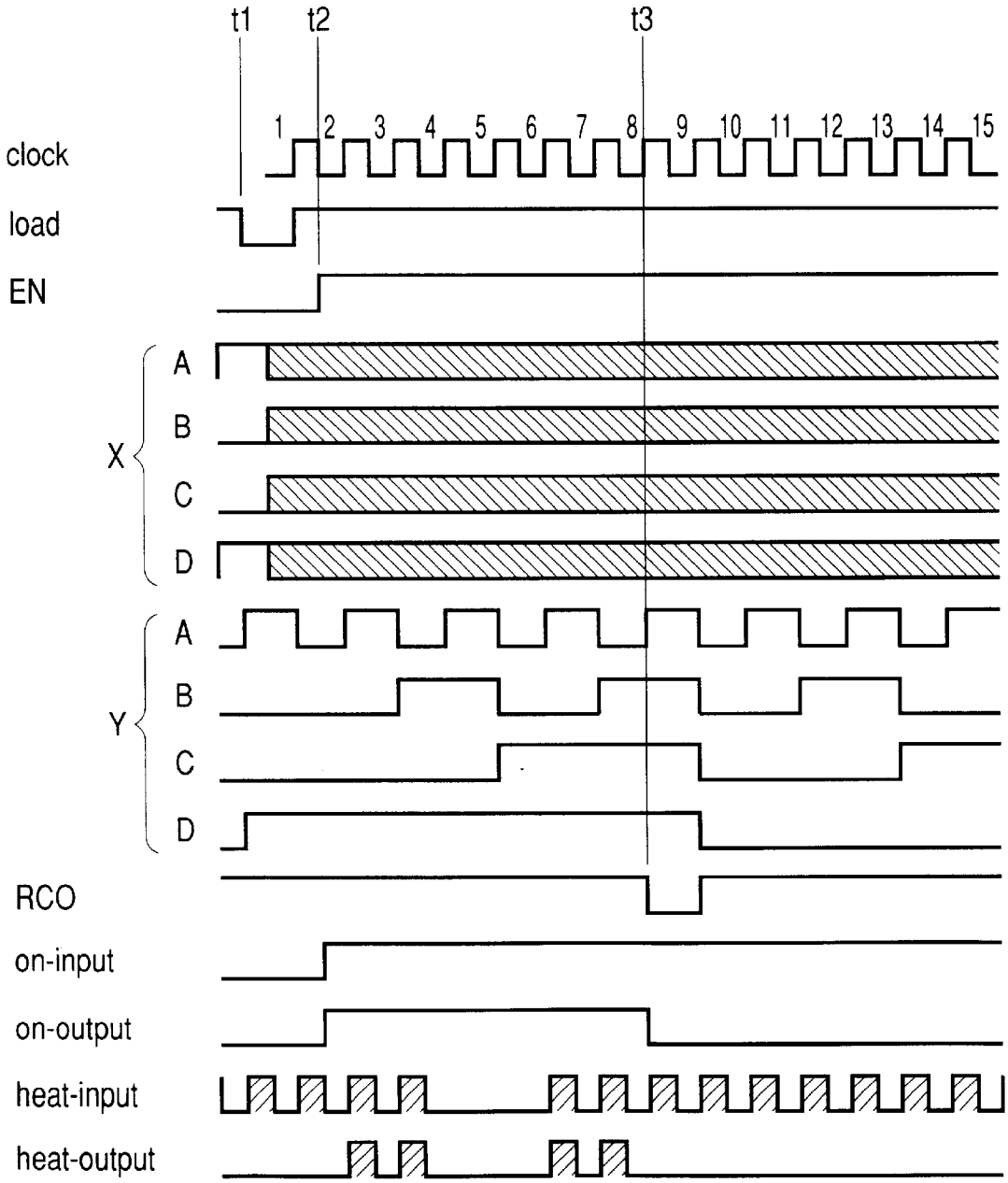
FIG. 21 is a timing chart showing input of serial data to the circuit shown in FIG. 19.

In the following there will be explained, with reference to a timing chart shown in FIG. 21, the function of driving the heat generating member based on the 4-bit data for the corresponding heat generating member, stored in the shift register 25. In FIG. 21, X indicates the input data to the binary counter, and Y indicates the count thereof.

The 4-bit parallel data from the shift register 25 are fetched into the binary counter 24 at the downshift edge (time t1) of the load signal Load. As an example, it is assumed that the 4-bit data fetched into the binary counter 24 are A=1, b=0, C=0 and D=1. The enable signal EN is shifted to a high level state (time t2) whereby the binary counter 24 starts upcounting operation. Then, when a state A=1, B=1, C=1 and D=1 is reached (time t3), the ripple carry output RCO assumes a low level state. On the other hand, the on-input signal On-input is shifted to the high level state when the enable signal EN assumes the high level state (time t2), so that the output signal On-Output of the flip-flop 23 assumes a high level state between t2 and t3.

The pulse generator 50 generates heat pulses Heat-Input to be given to each heat generating member, based on the heat signal Heat Data transmitted from the main body of the liquid discharge apparatus. In the illustrated example, based on the heat signal Heat Data, the pulse generator 50 generates two consecutive pulses synchronized with the clock signal CLK, then generates a nul pulse (having no actual pulse wave form) of two cycle periods synchronized with the clock signal CLK, and generates two consecutive pulses synchronized with the clock signal CLK. Since there are supplied, as the heat pulse Heat-Input, two pulses of a frequency same as that of the clock signal CLK, a pause corresponding to two pulses, and two pulses generated by the pulse generator 50, the output Heat-Output of the AND circuit 22 has four pulses between t2 and t3. As a result, the driving transistor 21 is driven by these four pulses whereby the heat generating member 10 is driven by two pulses, then pauses and driven again by two pulses, two and two droplets with a pause therebetween are discharged from the discharge port 4.

In the foregoing example, the discharged droplets are two-pause-two, but, as will be apparent from the foregoing, the interval between t2 and t3 is variable according to the 4-bit parallel data loaded into the binary counter 24, so that the discharged droplets can be controlled by a combination of consecutive discharges and a pause time according to the serial data supplied to the circuit and the reference pulse from the pulse generator. In this circuit, the shift register 25 executes an operation of converting serial data into parallel data, and the binary counter 24, flip-flop 23 and AND circuit 22 execute an operation of expanding or decoding the given parallel data to generate pulses of a number based on such data.

In the example shown in FIG. 19, as explained in the foregoing, the element substrate 1 incorporates the pulse generator 50 which generates the pulse pulse Heat-Input based on the heat signal Heat Data from the main body of the liquid discharge apparatus, whereby the pulse wave form does not become blunt in the transmission system from the exterior and there can be avoided the generation of abnormal pulse by the influence of noise in the course of transmission through the flexible cable from the main body of the apparatus. It is thus rendered possible to use the heat pulse Heat-Input of an extremely precise wave form thereby stabilizing the discharge characteristics and enabling to form highly precise multi drops for forming a high quality image. Also by forming the pulse generator in a same substrate by a process same as at least a part of the semiconductor process for forming other circuit portions, it is rendered possible to prevent an increase in the process cost and to drive the heat generating members with highly precise pulses. Also the use of the pulse generator enables high precise consecutive discharges including a pause, and also allows to separately utilize the divided landings of droplets and the integrated landing of droplets by conventional consecutive discharges without the pause in the photgraphic image, thereby obtaining an image of higher definition without granularity.

In the foregoing, the present invention has been explained, as a preferred embodiment thereof, a case of utilizing a liquid discharge head comprising a plurality of heat generating members for generating thermal energy for generating a bubble in liquid, a discharge port provided corresponding to each of the heat generating members and constituting a portion for discharging the liquid, a liquid flow path communicating with the discharge port and including a bubble generating area for generating a bubble in the liquid, a movable member provided in the bubble generating area and adapted to displace by the growth of the bubble, and a limiting portion for limiting the displacement of the movable member within a desired range, whereby the heat generating member and the discharge port are in a linear communicating state, the limiting portion is provided opposed to the bubble generating area of the liquid flow path, the liquid flow path including the bubble generating area constitutes a substantially closed space except for the discharge port by the substantial contact between the displaced movable member and the limiting portion, and the liquid is discharged from the discharge port by the eneregy of bubble generation in response to the application of a drive pulse. Naturally the present invention is applicable not only to the liquid discharge head of the above-described type but also to a head not provided with the movable member of a head for discharging liquid from the discharge port by energy other than thermal energy.

In the following there will be explained an ink jet recording apparatus utilizing the above-described liquid discharge head as an ink jet recording head.

Figure 22:
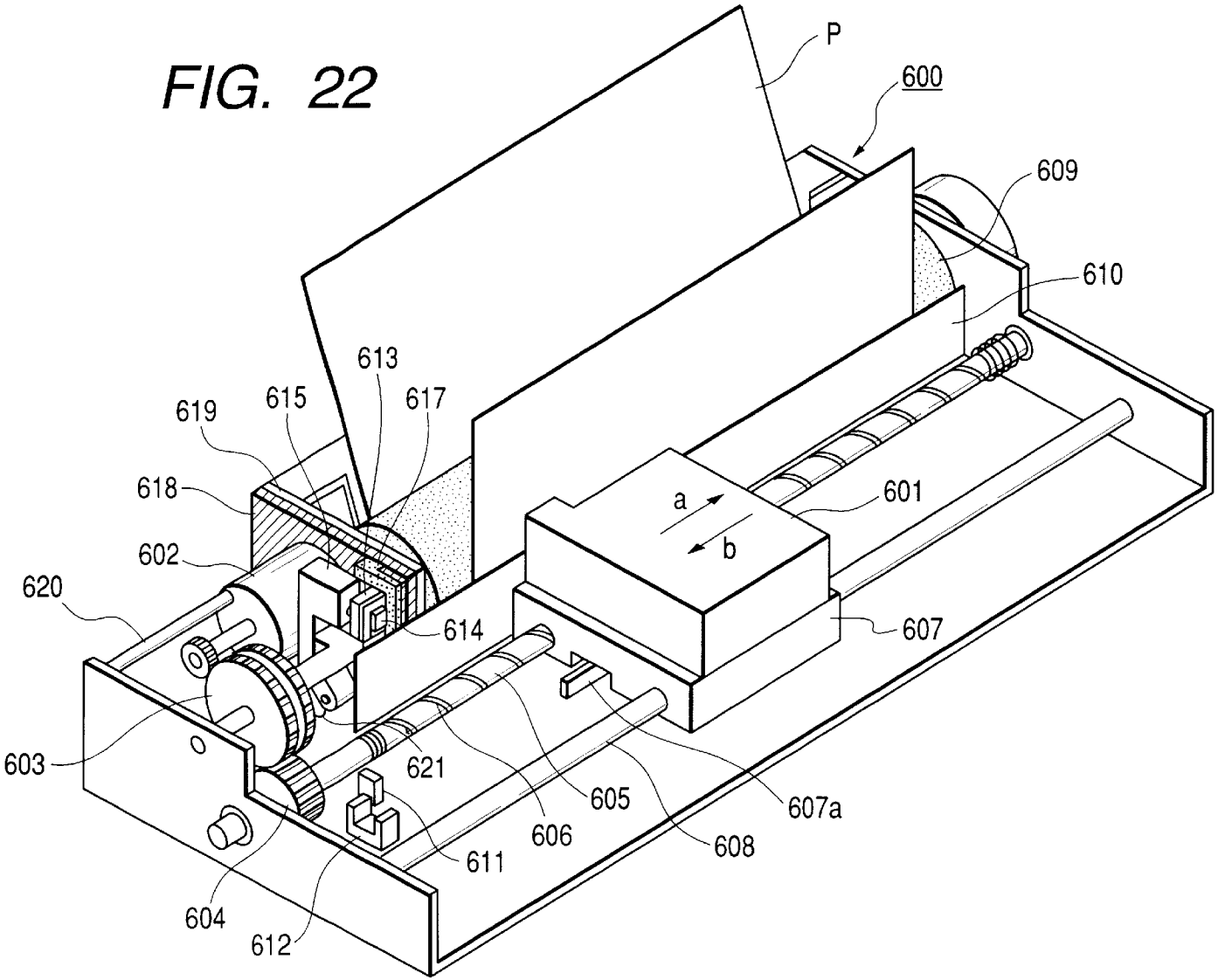
FIG. 22 is a perspective view of an ink jet recording apparatus utilizing the liquid discharge head of the present invention.
Figure 23:
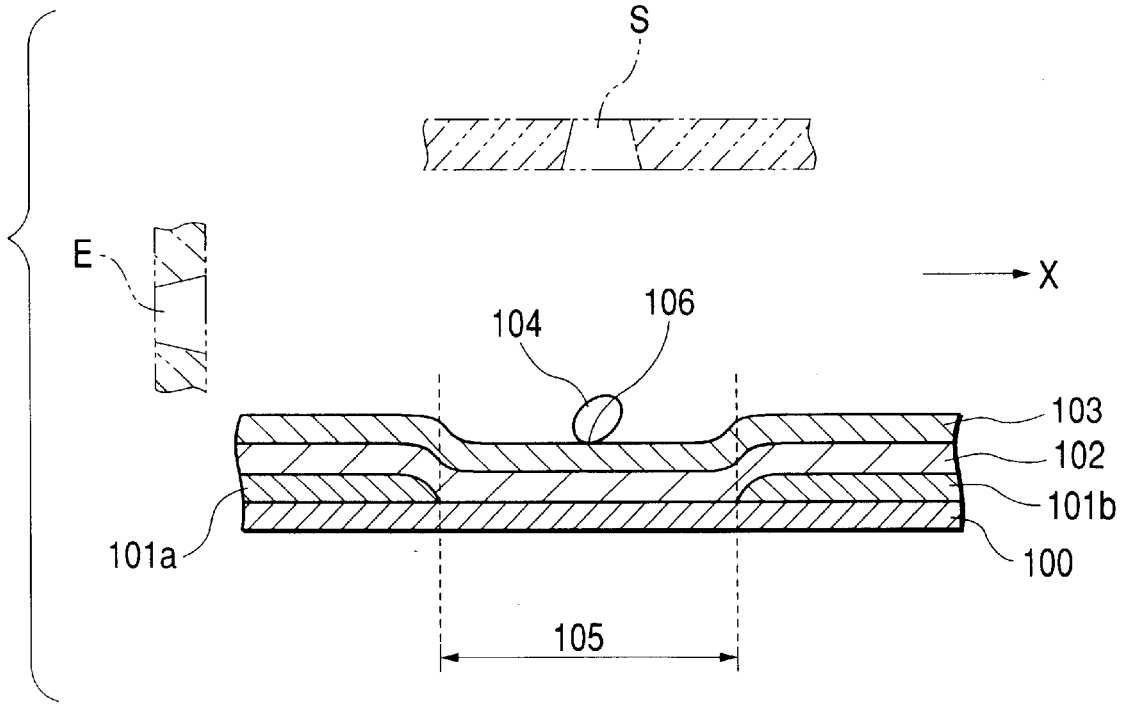
FIG. 23 is a schematic cross-sectional view showing the configuration around the heat generating member in a conventional liquid discharge head.

FIG. 22 is a schematic perspective view showing the principal parts of an ink jet recording apparatus to which the present invention is applicable. A head cartridge 601, mounted on the ink jet apparatus 600 shown in FIG. 22 is provided with a liquid discharge head capable of discharging ink for recording, and ink tanks of a plurality of colors for holding the liquids to be supplied to the liquid discharge head.

As shown in FIG. 22, the heat cartridge 601 is mounted on a carriage 607 engaging with a spiral groove 606 of a lead screw 605 rotated, through transmission gears 603, 604, by forward and reverse rotation of a driving motor 602. By the power of the motor 602, the heat cartridge 601 is reciprocated, together with the carriage 607, in directions a and b along a guid 608. The ink jet recording apparatus 600 is provided with recording medium conveying means (not shown) for conveying a print sheet P, constituting a recording medium for receiving liquid, such as ink, discharged from the heat cartridge 601. A pressing plate 610, for the print sheet P conveying by the recording medium conveying means on a platen 609, presses the print sheet P toward the platen 609 over the moving range of the carriage 607. The head cartridge 601 is electrically connected with the main body of the ink jet recording apparatus through an unrepresented flexible cable.

In the vicinity of an end of the lead screw 605, there are provided photocouplers 611, 612 which constitute home position detecting means for detecting the presence of a lever 607*a* of the carriage 607 in the area of the photocouplers 611, 612 thereby switching the rotating direction of the motor 602. Also in the vicinity of an end of the platen 609, there is provided a support member 613 for supporting a cap member 614 for covering the front face, having the discharge ports, of the head cartridge 601. There is also provided ink suction means 615 for sucking ink, discharged by idle discharge from the head cartridge 601 and contained in the interior of a cap member 614. The ink suction means 615 executes suction recovery of the heat cartridge 601 through an aperture of the cap member 614.

The ink jet recording apparatus 600 is provided with a main body support member 619, on which supported is a movable member 618, movably in front-back direction, namely a direction perpendicular to the moving direction of the carriage 607. A cleaning blade 617 is mounted on the movable member 618. However, the cleaning blade is not limited to such form but can be composed of any other known cleaning blade. In order to start the suction at the suction recovery operation by the ink suction means 615, there is provided a lever 620 which moves along the movement of a cam 621 engaging with the carriage 607 thereby controlling the driving force of the driving motor 602 by known transmission means such as a clutch. An ink jet recording control unit, for supplying signals to the heat generating members provided in the head cartridge 601 or controlling the drive of the aforementioned mechanisms, is provided in the main body of the recording apparatus and is not shown in FIG. 6.

In the ink jet recording apparatus 600 of the above-described configuration, the head cartridge 601 reciprocates over the entire width of the print sheet P conveyed on the platen 609 by the recording medium conveying means. When a drive signal is supplied to the head cartridge 601 from the unrepresented drive signal supply means in the course of such reciprocating motion, the liquid discharge head discharges ink (recording liquid) toward the recording medium in response to the signal, thereby effecting recording.

As explained in the foregoing, the liquid discharge head of the present invention is provided with a circuit for receiving data of a predetermined number of bits for each energy generating element such as the heat generating member and generating drive pulses for the corresponding heat generating member based on such input data, wherein the number of drive pulse generated from the input data is made larger than a predetermined number of bits at least for a set of data, thereby providing an advantage of enabling multi-level recording or high-speed discharge with a relatively low data transfer rate.

Also there is provided a circuit for receiving serial data of a predetermined number of bits (2 bits or larger) for each energy generating element (such as the heat generating member), extracting data for each energy generating element from such serial data and generating drive pulses for each energy generating element based on the extracted data, thereby providing an advantage of enabling multi-level recording or high-speed discharge with a relatively low data transfer rate.

Also there is obtained an advantage that the data amount required for image formation is represented by number of energy generating elements×number of gradation bits which is less than number of energy generating elements×(number of dots or steps) in the conventional method, thereby saving the memory capacity. Also, since the gradational representation is possible by independent drop modulation for each nozzle by simultaneous scanning, there can be obtained an advantage of realizing high quality at a high speed.

Also by connecting a data decoder to the parallel data output of a shift register for converting serial data into parallel data and generating the drive pulses based on the output of the data decoder, there can be reduced the magnitude of the circuit provided in the liquid discharge head thereby significantly reducing the chip area.

Also the element substrate of the present invention allows to easily construct a liquid discharge head capable of achieving multi-level recording or high-speed discharge with a relatively low data transfer rate.

The liquid discharge apparatus of the present invention has advantages of matching the multi-nozzle, multi-level recording and also capable of precisely discharging liquid from each discharge port by sending the drive signal of a relatively low frequency to the liquid discharge head.

The liquid discharge method of the present invention, is featured by utilizing a liquid discharge head provided with a circuit for receiving serial data of a predetermined number of bits for each heat generating member, extracting data for each heat generating member from such serial data and generating drive pulses for each heat generating member, and applying a drive pulse to a succeeding liquid discharge while a bubble for the preceding liquid discharge, in the course of vanishing, still remains in the downstream side of the bubble generating area, thereby enabling successive satisfactory liquid discharges with a short interval exceeding the limit of the conventional technology, namely enabling drive of the liquid discharge head with a very high frequency. In such operation, in comparison with the case of starting the liquid discharge from the stationary state, the amount of the droplet discharged in succession can be made larger, and the discharge velocity can also be made larger. Also a part of the energy generated in the preceding liquid discharge can be made to contribute to the succeeding liquid discharge, thereby improving the efficiency of the energy for liquid discharge.

What is claimed is:

1. A liquid discharge head comprising:

a plurality of heat generating members for generating thermal energy for generating a bubble in liquid;

a discharge port provided for each of said heat generating members and constituting a portion for discharging said liquid;

a liquid flow path communicating with said discharge port and including a bubble generating area for generating a bubble in the liquid; a movable member provided in said bubble generating area and adapted to displace among with the growth of said bubble;

a limiting portion for limiting the displacement of said movable member within a desired range; and a circuit for receiving data of a predetermined number of bits for each heat generating member and generating drive pulses for the corresponding heat generating member based on the input data;

wherein said heat generating member and said discharge port are in a linear communicating relationship, said limiting portion is provided opposed to said bubble generating area in said liquid flow path, and the liquid flow path including said bubble generating area constitutes a substantially closed space except for said discharge port by the substantial contact between said displaced movable member and said limiting portion; and the number of said drive pulses generated from said input data is larger than said predetermined number of bits at least for a set of said data; and said liquid is discharged from said discharge port by the energy of bubble generation by the application of said drive pulse.

2. A liquid discharge head according to claim 1, wherein said input data are serial data.

3. A liquid discharge head according to claim 1, wherein said circuit executes an operation of not applying drive pulse, an operation of applying only one drive pulse, or an operation of applying drive pulses of a number represented by said data for each heat generating member, according to said data for each heat generating member.

4. A liquid discharge head according to claim 3, wherein said input data are serial data, and said circuit includes:

a shift register for extracting data for each heat generating member as parallel data from said serial data; and means provided for each heat generating member and adapted for generating drive pulses of a number represented by said corresponding parallel data.

5. A liquid discharge head according to claim 1, wherein each of said heat generating members is independently controlled.

6. A liquid discharge head according to claim 1, wherein the predetermined number of bits for each of said heat generating members is less than the number of gradation level bits.

7. A liquid discharge head comprising:

a plurality of discharge ports constituting a portion for discharging liquid;

an element provided for each of said discharge ports and adapted for generating energy for discharging said liquid; and a circuit for receiving data of a predetermined number of bits at least equal to 2 bits for each heat generating member and generating a number of drive pulses, the number of drive pulses corresponding to what is obtained by converting said entered data, wherein said liquid is discharged from said discharge port by the energy generated by the application of said drive pulse to said energy generating element.

8. A liquid discharge head according to claim 7, wherein said input data are serial data.

9. A liquid discharge head according to claim 7, wherein said circuit includes means for decoding data for each of said heat generating elements and means for generating said drive pulse according to the result of decoding.

10. A liquid discharge head according to claim 5, wherein said circuit executes an operation of not applying drive pulse, an operation of applying only one drive pulse, or an operation of applying drive pulses of a number represented by said data for each heat generating member, according to said data for each heat generating member.

11. A liquid discharge head according to claim 10, wherein said input data are serial data, and said circuit includes: a shift register for extracting data for each heat generating member as parallel data from said serial data; and means provided for each heat generating member and adapted for generating drive pulses of a number represented by said corresponding parallel data.

12. A liquid discharge head according to claim 7, wherein said circuit applies, to the corresponding heat generating member, two pulses with an interval varying according to the data for said energy generating member.

13. A liquid discharge head according to claim 12, wherein said input data are serial data, and said circuit includes:

a shift register for extracting data for each heat generating member as parallel data from said serial data; and means provided for each heat generating member and adapted for generating said two drive pulses with an interval represented by said corresponding parallel data.

14. A liquid discharge head according to claim 7, wherein said energy generating element is a heat generating member for generating thermal energy for generating a bubble in the liquid, there is further provided a liquid flow path including a bubble generating area for generating the bubble in said liquid, and said liquid is discharged from said discharge port by the energy at the bubble generation area by application of said drive pulse.

15. A liquid discharge head according to claim 7, wherein each of said energy generating elements is independently controlled.

16. A liquid discharge head according to claim 7, wherein the predetermined number of bits for each of said heat generating members is less than the number of gradation level bits.

17. A liquid discharge apparatus comprising a carriage for mounting said liquid discharge head according to claim 7, wherein said liquid discharge head discharges liquid droplets while said serial data are transmitted to said liquid discharge head and said carriage is moved according to recording information.

18. A liquid discharge head comprising:

a plurality of discharge ports constituting a portion for discharging liquid;

an energy generating element provided for each of said discharge ports and adapted for generating energy for discharging said liquid; and a circuit including a shift register for receiving serial data of a predetermined number of bits for each heat generating member and extracting data for each energy generating member as parallel data from said serial data, a data decoder for decoding said parallel data, and a logic circuit for applying a number of drive pulses to each energy generating element on the basis of a reference pulse, the number of drive pulses corresponding to an output of said data decoder, wherein said liquid discharged from said discharge port by the energy generated by the application of said drive pulse to said energy generating element.

19. A liquid discharge head according to claim 18, further comprising a pulse generator for generating said reference pulse based on a control signal.

20. A liquid discharge head according to claim 19, wherein said data decoder is a binary counter.

21. A liquid discharge head according to claim 19, wherein said data decoder is a conversion table.

22. A liquid discharge head according to claim 18, wherein said energy generating element is a heat generating member for generating thermal energy for generating a bubble in the liquid, there is further provided a liquid flow path including a bubble generating area for generating the bubble in said liquid, and said liquid is discharged from said discharge port by the energy at the bubble generation by application of said drive pulse.

23. A liquid discharge head according claim 22, further comprising:

a movable member provided in said bubble generating area and adapted to displace along with the growth of said bubble; and a limiting portion for limiting the displacement of said movable member within a desired range;

wherein said heat generating member and said discharge port are in a linear communicating relationship, said limiting portion is provided opposed to said bubble generating area in said liquid flow path, and the liquid flow path including said bubble generating area constitutes a substantially closed space except for said discharge port by the substantial contact between said displaced movable member and said limiting portion.

24. A liquid discharge head according to claim 23, wherein each of said energy generating members is independently controlled.

25. A liquid discharge head according to claim 23, wherein the predetermined number of bits for each of said heat generating members is less than the number of gradation level bits.

26. A liquid discharge head according to claim 23, wherein said circuit and said plurality of heat generating members are formed on a single element substrate.

27. A liquid discharge head according to claim 18, further comprising:

a movable member provided in said bubble generating area and adapted to displace along with the growth of said bubble; and a limiting portion for limiting the displacement of said movable member within a desired range;

wherein said heat generating member and said discharge port are in a linear communicating relationship, said limiting portion is provided opposed to said bubble generating area in said liquid flow path, and the liquid flow path including said bubble generating area constitutes a substantially closed space except for said discharge port by the substantial contact between said displaced movable member and said limiting portion.

28. A liquid discharge head according to claim 18, wherein said circuit and said plurality of heat generating members are formed on a single element substrate.

29. A liquid discharge head according to claim 18, wherein said energy generating element is a heat generating member for generating thermal energy for generating a bubble in the liquid, there is further provided a liquid flow path including a bubble generating area for generating the bubble in said liquid, and said liquid is discharged from said discharge port by the energy at the bubble generation by application of said drive pulse.

30. A liquid discharge head according to claim 29, wherein said circuit said plurality of heat generating members are formed on a single element substrate.

31. A liquid discharge method utilizing a liquid discharge head including a heat generating member for generating thermal energy for generating a bubble in liquid; a discharge port constituting a portion for discharging said liquid; a liquid flow path communicating with said discharge port and including a bubble generating area for generating a bubble in the liquid; a liquid chamber for supplying said liquid flow path with said liquid; a movable member provided in said bubble generating area and adapted to displace along with the growth of said bubble; a limiting portion for limiting the displacement of said movable member within a desired range; and a circuit for receiving serial data of a predetermined number of bits for each heat generating member, extracting data for each heat generating member from said serial data and generating drive pulses for each heat generating member based on the extracted data; wherein said heat generating member and said discharge port are in a linear communicating relationship and said liquid is discharged from said discharge port by the energy at said bubble generation, said limiting portion is provided opposed to said bubble generating area in said liquid flow path, and the liquid flow path including said bubble generating area constitutes a substantially closed space except for said discharge port by the substantial contact between said displaced movable member and said limiting portion; thereby discharging a plurality of liquid droplets in succession from a same discharge port;

wherein the drive energy for a succeeding liquid discharge is supplied to said heat generating member by said drive pulse in a state where a bubble formed for a preceding liquid discharge and in the course of vanishing still remains at the discharge port side of said bubble generating area and no other bubble is present at the liquid chamber side.

32. A liquid discharge method according to claim 31, wherein the volume of the discharged liquid droplet at a second or subsequent liquid discharge is larger than that in the liquid discharge starting from a stationary state.

33. A liquid discharge method according to claim 32, wherein the speed of the discharged liquid droplet at a second or subsequent liquid discharge is larger than that in the liquid discharge starting from a stationary state.

34. A liquid discharge method according to claim 33, wherein said plurality of liquid droplets discharged in succession are united in the course of flight and thereafter land on a recording material.

35. A liquid discharge method according to claim 33, wherein said plurality of liquid droplets discharged in succession are united in the course of flight and thereafter land on a recording material after landing thereon.

36. A liquid discharge method according to claim 31, wherein the speed of the discharged liquid droplet at a second or subsequent liquid discharge is larger than that in the liquid discharge starting from a stationary state.

37. A liquid discharge method according to claim 31, wherein said plurality of liquid droplets discharged in succession are united in the course of flight and thereafter land on a recording material.

38. A liquid discharge method according to claim 31, wherein said plurality of liquid droplets discharged in succession are united in the course of flight and thereafter land on a recording material after landing thereon.

* * * * *

UNITED STATES PATENT AND TRADEMARK OFFICE

CERTIFICATE OF CORRECTION

PATENT NO. : 6,761,434 B2
DATED : July 13, 2004
INVENTOR(S) : Hiroyuki Ishinaga et al.

It is certified that error appears in the above-identified patent and that said Letters Patent is hereby corrected as shown below:

Column 2,
Line 1, “oppening” should read -- opening --.

Column 3,
Line 47, “liquid” should read -- liquid is --.

Column 5,
Line 13, “dischrage” should read -- discharge --.

Column 14,
Line 24, “plate” should read -- place --.

Column 15,
Line 6, “buble” should read -- bubble --; and
Line 67, “accelerates” should read -- accelerate --.

Column 16,
Line 2, “completes” should read -- complete --; and
Line 8, “liquid” should read -- liquid is --.

Column 18,
Line 4, “lliquid” should read -- liquid --; and
Line 45, “these a” should read -- this --.

Column 19,
Line 15, “exclusing” should read -- excluding --.

Column 20,
Line 24, “regisers” should read -- registers --; and
Line 52, “b=0,” should read -- B=0, --.

Column 23,
Line 57, “hat-input” should read -- heat-input --.

Column 24,
Line 15, “droplet” should read -- droplets --; and
Line 26, :intervgal” should read -- interval --.

UNITED STATES PATENT AND TRADEMARK OFFICE

CERTIFICATE OF CORRECTION

PATENT NO. : 6,761,434 B2
DATED : July 13, 2004
INVENTOR(S) : Hiroyuki Ishinaga et al.

It is certified that error appears in the above-identified patent and that said Letters Patent is hereby corrected as shown below:

Column 25,
Line 14, “an” should read -- to an --; and
Line 53, “resigers” should read -- registers --.

Column 26,
Line 2, “b=0,” should read -- B=0, --;
Line 16, “nul” should read -- null --; and
Line 45, “pulse pulse” should read -- pulse --.

Column 27,
Line 44, “guid” should read -- guide --.

Column 28,
Line 36, “pulse” should read -- pulses --.

Column 29,
Line 39, “a movable” should read -- ¶ a movable --; and
Line 41, “among” should read -- along --.

Column 31,
Line 34, “discharged” should read -- is discharged --.

Column 32,
Line 36, “circuit said” should read -- circuit and said --.

Signed and Sealed this

Nineteenth Day of October, 2004

JON W. DUDAS
*Director of the United States Patent and Trademark Office*